US011889877B2

(12) United States Patent
Simmons et al.

(10) Patent No.: US 11,889,877 B2
(45) Date of Patent: Feb. 6, 2024

(54) GARMENT WITH ADAPTIVE VENTILATION

(71) Applicant: NIKE, Inc., Beaverton, OR (US)

(72) Inventors: Grant H. Simmons, Portland, OR (US); Patrick Williams, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 846 days.

(21) Appl. No.: 16/275,593

(22) Filed: Feb. 14, 2019

(65) Prior Publication Data

US 2019/0365000 A1 Dec. 5, 2019

Related U.S. Application Data

(60) Provisional application No. 62/678,679, filed on May 31, 2018.

(51) Int. Cl.
*A41D 27/28* (2006.01)
*A41D 31/14* (2019.01)

(52) U.S. Cl.
CPC ..... *A41D 27/28* (2013.01); *A41D 31/14* (2019.02); *A41D 2500/10* (2013.01); *A41D 2500/50* (2013.01)

(58) Field of Classification Search
CPC .... A41D 27/28; A41D 31/14; A41D 2500/10; A41D 2500/50
See application file for complete search history.

(56) References Cited

U.S. PATENT DOCUMENTS 2,259,560 A * 10/1941 Glidden ..... A41D 27/28 2/87
2,607,104 A * 8/1952 Foster ..... B29C 61/02 428/101
3,213,465 A * 10/1965 Ludwikowski ..... A41D 27/28 2/268
3,228,821 A * 1/1966 Trope ..... A41D 27/28 2/87
3,296,626 A * 1/1967 Ludwikowski ..... A41D 27/28 2/87

(Continued)

FOREIGN PATENT DOCUMENTS

CN 2215203 Y 12/1995
CN 204617103 U 9/2015

(Continued)

OTHER PUBLICATIONS

International Search Report and Written Opinion dated Apr. 24, 2019 in International Patent Application No. PCT/US2019/019381, 16 pages.

(Continued)

*Primary Examiner* — Richale L Quinn
(74) *Attorney, Agent, or Firm* — SHOOK, HARDY & BACON L.L.P

(57) ABSTRACT

Aspects herein are directed to garments with adaptive ventilation. The garment has one or more flaps that open and close in response to the presence or absence of an external stimulus such as, for example, moisture. The one or more flaps remain closed in the absence of the external stimulus and open in the presence of the external stimulus thereby increasing or decreasing ventilation between an interior cavity of the garment and an external environment.

20 Claims, 14 Drawing Sheets

(56) References Cited

U.S. PATENT DOCUMENTS

| | | | | | |
|---|---|---|---|---|---|
| 3,706,102 | A * | 12/1972 | Grenier | A41D 31/14 | 2/84 |
| 3,857,753 | A * | 12/1974 | Hansen | F16L 59/04 | 428/76 |
| 3,969,772 | A * | 7/1976 | Pravaz | B64D 17/00 | 2/79 |
| 4,451,934 | A * | 6/1984 | Gioello | A41D 31/14 | 2/113 |
| 5,704,064 | A * | 1/1998 | van der Sleesen | A41D 27/28 | 2/108 |
| 6,070,274 | A * | 6/2000 | van der Sleesen | A41D 27/28 | 2/DIG. 1 |
| 6,767,850 | B1 * | 7/2004 | Tebbe | A41D 31/04 | 442/325 |
| 7,842,628 | B2 * | 11/2010 | Yasui | A41B 17/00 | 442/310 |
| 8,336,117 | B2 * | 12/2012 | Carter | A41D 31/102 | 2/87 |
| 8,850,615 | B2 * | 10/2014 | Demarest | A41D 27/28 | 2/DIG. 1 |
| 9,392,825 | B2 * | 7/2016 | Pezzimenti | B29C 66/433 | |
| 9,668,531 | B2 * | 6/2017 | Nordstrom | B32B 3/14 | |
| 9,700,077 | B2 * | 7/2017 | Baron | D04B 21/207 | |
| 10,111,480 | B2 * | 10/2018 | Pezzimenti | A41D 1/04 | |
| 10,238,157 | B2 * | 3/2019 | Nordstrom | A41D 31/145 | |
| 10,687,572 | B2 * | 6/2020 | Baker | A41D 31/14 | |
| 10,793,981 | B2 * | 10/2020 | Ridley | B32B 5/026 | |
| 10,814,514 | B2 * | 10/2020 | Aihara | A41D 27/285 | |
| 10,874,154 | B2 * | 12/2020 | Aitch | A41D 27/285 | |
| 11,019,865 | B2 * | 6/2021 | Pezzimenti | A41D 27/02 | |
| 11,076,651 | B2 * | 8/2021 | Baron | A41D 1/04 | |
| 11,122,846 | B2 * | 9/2021 | Lao | D06M 23/16 | |
| 11,154,100 | B2 * | 10/2021 | Molyneux | A41D 13/012 | |
| 11,192,326 | B2 * | 12/2021 | Huang | C08J 5/22 | |
| 2005/0204449 | A1 * | 9/2005 | Baron | D03D 15/49 | 2/69 |
| 2007/0161305 | A1 * | 7/2007 | Wangbunyen | A41D 27/285 | 442/79 |
| 2007/0184238 | A1 * | 8/2007 | Hockaday | B32B 27/36 | 428/98 |
| 2008/0274657 | A1 * | 11/2008 | Yashiro | D03D 1/0041 | 442/201 |
| 2010/0242151 | A1 * | 9/2010 | Mather | D04B 21/16 | 2/115 |
| 2011/0052861 | A1 | 3/2011 | Rock | | |
| 2012/0142266 | A1 * | 6/2012 | Niwa | F24F 11/0008 | 454/339 |
| 2013/0133353 | A1 * | 5/2013 | Araujo | F25D 31/00 | 62/331 |
| 2014/0000004 | A1 * | 1/2014 | Baron | D04B 21/207 | 2/69 |
| 2014/0310846 | A1 | 10/2014 | Carter et al. | | |
| 2016/0339594 | A1 * | 11/2016 | Aihara | A41D 31/14 | |
| 2017/0035128 | A1 | 2/2017 | Baron et al. | | |
| 2017/0273377 | A1 * | 9/2017 | Aihara | A41B 1/08 | |
| 2019/0061307 | A1 * | 2/2019 | Chen | A41D 27/285 | |
| 2019/0365001 | A1 * | 12/2019 | Perera | D04B 1/16 | |
| 2022/0132960 | A1 * | 5/2022 | Baron | A41D 13/0015 | 2/115 |

FOREIGN PATENT DOCUMENTS

| | | | |
|---|---|---|---|
| CN | 205611824 | U | 10/2016 |
| EP | 3449743 | A1 | 3/2019 |
| TW | 552932 | | 9/2003 |
| WO | 2017096044 | A1 | 6/2017 |

OTHER PUBLICATIONS

International Preliminary Report on Patentability received for PCT Patent Application No. PCT/US2019/019381, dated Dec. 10, 2020, 9 pages.

Office Action received for European Patent Application No. 19710239.5 dated Mar. 7, 2023, 5 pages.

* cited by examiner

GARMENT WITH ADAPTIVE VENTILATION

CROSS-REFERENCE TO RELATED APPLICATIONS

This U.S. application Ser. No. 16/275,593 entitled "Garment with Adaptive Ventilation," and filed on Feb. 14, 2019 claims the benefit of priority of U.S. Prov. App. No. 62/678,679, entitled "Garment with Adaptive Ventilation," and filed on May 31, 2018. The entirety of the aforementioned application is incorporated by reference herein.

TECHNICAL FIELD

Aspects herein relate to garments with adaptive ventilation.

BACKGROUND

Traditional garments may achieve breathability and/or permeability by employing a mesh-type material to form "vents" in an article. However, the "vents" are generally always in an open configuration, which in some instances may be undesirable.

DESCRIPTION OF THE DRAWINGS

Examples of aspects herein are described in detail below with reference to the attached drawing figures, wherein.

DETAILED DESCRIPTION

Figure 1A:
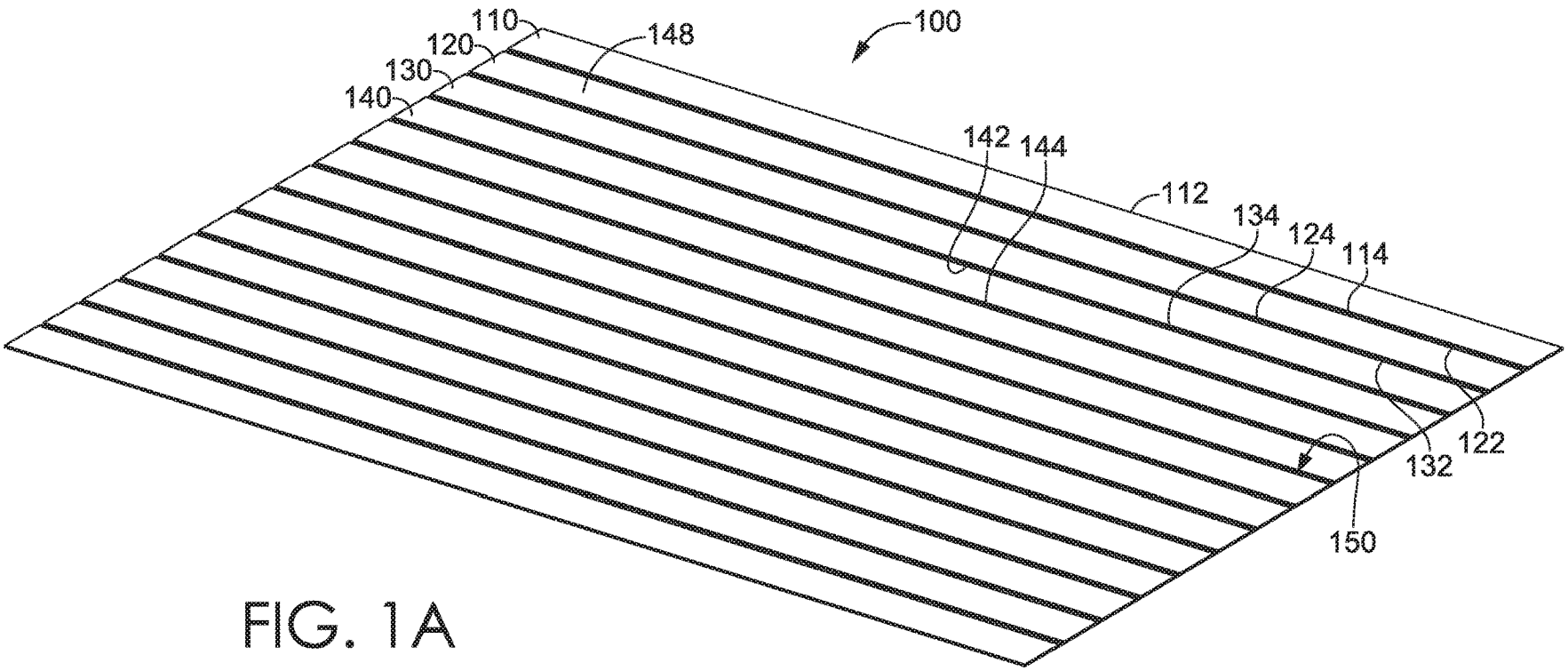
FIG. 1A illustrates a perspective view of an adaptive ventilation textile to be used in a garment to provide adaptive ventilation where the textile is in a first state in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein relate to articles with adaptive ventilation that allow increased airflow in and out of the article based on the presence or absence of a change-inducing stimulus. The change-inducing stimulus may be an external stimulus meaning that it is external to the fibers, yarns, filaments, or structure of the materials forming the article. The external stimulus may include, for example, heat (i.e., increasing temperature), moisture, wind pressure, light, and the like. The articles in accordance with aspects herein may include upper body garments, lower body garments, support garments such as bras, camisoles, tank tops, and the like, as well as undergarments such as panties and socks, articles of footwear (e.g., an upper of a shoe), bags, sleeping bags, and the like, where adaptive ventilation may be beneficial.

In one aspect, the articles may include garments such as upper body garments and lower body garments. In the case of an upper body garment, for example, the garment may comprise a torso portion defining a neckline opening, a waist opening, and left and right arm openings. Optionally, the garment may further comprise a pair of sleeves attached to the left and right arm openings. In one example of an aspect, the garment may comprise one or more adaptive ventilation garment portions comprising one or more flaps located on a back aspect of the torso portion of the upper body garment. The garment may additionally comprise one or more non-adaptive ventilation garment portions. Each flap may comprise an attachment edge which integrally extends from, for instance, a mesh backing layer where the backing layer, at least in part, helps to form the back aspect of the torso portion. In the case of a lower body garment, for example, the garment may comprise one or more adaptive ventilation garment portions on a front thigh area, a back thigh area, along the whole leg area, a back calf area, and the like. In example aspects, the flaps may transition from a closed state to an open state in the presence of an external stimulus thereby exposing the mesh backing layer and increasing the permeability of the adaptive ventilation garment portions.

Continuing, beside its attachment edge, each flap may also comprise a distal edge or free edge that is detached from the backing layer. Further, each flap may be defined by an intervening length extending between the attachment edge and the distal edge. The intervening length of each flap may define the length of the flap. As well, each flap may comprise a first face and a second face opposite the first face, with the first face facing the backing layer when each flap is in its non-stimulated or closed state.

The first face may be formed from a first yarn type and the second face may be formed from a second yarn type. In accordance with aspects herein, the first yarn type may comprise a yarn comprising a plurality of bi-component filaments, where each bi-component filament may be comprised of a first polymeric composition. The first polymeric composition of the bi-component filament may include, for example, a polymer sensitive to an external stimulus such as a polyamide polymer (sensitive to, in this case, moisture, moisture vapor, and/or water) and a polymer that is not sensitive to the external stimulus such as a terephthalate polymer (not sensitive to, in this case, moisture, moisture vapor, and/or water). The second yarn type present on the second face of each flap, on the other hand, may be comprised of a second polymeric composition that is different from the first polymeric composition of the first yarn type on the first face of each flap. For example, the second polymeric composition may be comprised of a polymer that is not sensitive to the external stimulus, such as a terephthalate polymer (not sensitive to, in this case, moisture).

In aspects, the bi-component filaments of the first yarn type exist in a "crimped" or shortened state in the absence of the external stimulus because, for example, the stimulus sensitive polymer may be in a contracted state, while the non-stimulus sensitive polymer may be in its regular state or regular length. Then, in the presence of the external stimulus, the crimped bi-component filament straightens as the stimulus sensitive polymer elongates and/or expands. The polymers in the bi-component filament may be arranged in a side-by-side relationship, meaning that they form the two sides of the filament along a lengthwise direction of the filament. Thus, a change of the stimulus sensitive polymer from a contracted state to a straightened state translates along the length of the yarn causing the first yarn type to uncrimp or lengthen in the presence of the external stimulus.

In one aspect, the ratio by weight between the stimulus sensitive polymer and the non-stimulus sensitive polymer may be about 50/50. In another aspect, the ratio by weight of one polymer to the other may not be 50/50, but rather, one polymer may comprise a higher percentage by weight compared to the other polymer. Any and all aspects, and any variation thereof, are in accordance with aspects herein.

In accordance with aspects herein, as mentioned, in the absence of the external stimulus, the first yarn type exists in a "crimped" or shortened state. In the presence of the external stimulus, such as moisture, however, the first yarn type transitions from a crimped state to an uncrimped state. In other words, the first yarn type lengthens in the presence of the external stimulus. With respect to the flap, as mentioned, the first face of the flap is formed from yarns comprising the bi-component filaments. Thus, in the presence of the external stimulus a longitudinal lengthening of the first face of the flap occurs (i.e., a lengthening as measured between the attachment edge and the distal edge of the flap). However, because the second face of the flap is formed from a non-stimulus sensitive polymeric composition, the second face of the flap does not lengthen in the presence of the external stimulus. The result of this is that longitudinal lengthening of the first face of the flap is constrained by the second face so the first face of the flap begins to curl around the free edge of the flap in the direction of the second face in the presence of the external stimulus causing the flap to open and expose the backing layer. The change caused in each flap by the presence of the external stimulus, in accordance with aspects herein, is reversible meaning that once the external stimulus is gone, each flap returns to its original state where the bi-component filaments of the first yarn type return to their crimped state, allowing each flap to close.

In one aspect, the first yarn type may be treated with a hydrophobic coating material such as a durable water-repellant (DWR) coating prior to incorporating the first yarn type into the adaptive ventilation textile. In another aspect, the adaptive ventilation textile, or the first face of each flap of the adaptive ventilation textile, may be coated with the hydrophobic coating after the knitting or weaving of the adaptive ventilation textile (i.e., in a post-processing step). The hydrophobic coating in accordance with aspects herein may be resistant to liquid water penetration but may be permeable to moisture that is in vapor form. As such, the adaptive ventilation textile having a hydrophobic coating treatment or incorporating a coated first yarn type, may be incorporated into garments such as rain coats, and the like that may likely be exposed to moisture in the form of liquid precipitation. In this aspect, because the one or more flaps of the adaptive ventilation textile would be less sensitive or not sensitive to liquid moisture, i.e, configured to repel liquid moisture (e.g., rain, snow, sprinklers, and the like), the flaps would remain in a closed state upon exposure to precipitation thereby helping to keep the wearer dry. However, because the DWR coating may still be permeable to moisture vapor from, for instance, wearer perspiration, the flaps may transition from a closed state to an open state when the wearer begins perspiring thereby helping to keep the wearer comfortable.

The backing layer from which the attachment edge of each flap extends may be comprised of a breathable/permeable textile having a plurality of openings that are either integrally formed by the knitting process used to form the backing layer and/or formed in a post-knitting step using, for instance, cutting methodologies known in the art (e.g., laser cutting, die cutting, and the like). For example, the backing layer may be comprised of a mesh type, a net type, or any other suitable pliable material having a plurality of openings for allowing air flow. Each flap that extends from the backing layer at its respective attachment edge may be configured to, as described above, open in the presence of an external stimulus and stay in a closed configuration in the absence of the external stimulus. In other words, each flap has a first angle of deflection formed between the backing layer and the first face of each flap in its closed state that is less than a second angle of deflection formed between the backing layer and the first face of each flap in its open state. The opening of the flap exposes the backing layer allowing for greater air circulation to an interior cavity of a garment incorporating the adaptive ventilation textile.

When multiple flaps are present, the attachment edges of the respective flaps may be in a generally parallel but offset alignment with each other. And, similarly, the distal edges of the respective flaps may also be in a generally parallel but offset alignment with each other. In aspects, the distal edge of one flap may be generally aligned with but not overlap the attachment edge of another flap when the flaps are in their closed state, where depending on the intervening length of each flap, the backing layer may be or may not be visible when the flaps are in their closed state. Alternatively, a portion of the distal edge of one flap may overlap a portion of the attachment edge of another flap, or in other words, the distal edge of one flap may extend over the attachment edge of the next flap thereby concealing the attachment edge of the next flap when the plurality of flaps are in their closed state. As well, it is to be noted that the backing layer may be concealed when the flap or multiple flaps are in their closed state and the backing layer becomes, in part, exposed when the flap or multiple flaps are in their open state, allowing for ventilation and higher air permeability in a garment comprising the adaptive ventilation textile.

The one or more flaps in accordance with aspects herein may be horizontally oriented (i.e., lengthwise parallel with respect to a waistline of the garment), vertically oriented (i.e., lengthwise orthogonal with respect to a waistline of the garment), or diagonally oriented (i.e., any angle between 0.1 and 89.9 degrees and any angle between 90.1 and 179.9 degrees with respect to a waistline of the garment).

Garments incorporating the adaptive ventilation textile described herein may comprise one or more adaptive ventilation textile portions and one or more base textile portions (e.g., non-adaptive ventilation textile portions). In this aspect, the adaptive ventilation textile portions may undergo a greater change in air permeability when transitioning from a dry state to a wet state as compared to, for instance, the non-adaptive ventilation textile portions. As such, the adaptive ventilation textile portions may be positioned on the garment to correspond to high heat and/or sweat producing areas of the human body where the increased air permeability in wet or high perspiration conditions may help to cool the wearer. The non-adaptive ventilation textile portions, on the other hand, may be positioned on the garment in areas of the wearer where an increased permeability may be less desirable. For instance, the non-adaptive ventilation textile portions may be placed in areas where increased warmth may be needed.

Accordingly, aspects herein are directed to a garment comprising a torso portion defining a neckline opening, a waist opening, a first arm opening, and a second arm opening. A back aspect of the torso portion of the garment comprises a flap that is located a predefined distance superior to the waist opening. The flap comprises an attachment edge, a distal edge, a first face, and a second face opposite the first face, where the first face is formed from a first yarn type and the second face is formed from a second yarn type. The first yarn type forming the first face is comprised of a plurality of bi-component filaments. The second yarn type is comprised of a polymeric composition that is different from the first yarn type on the first face.

Aspects herein are further directed to a garment comprising a first panel comprising a plurality of integrally formed flaps, each of the plurality of integrally formed flaps having a first face and a second face opposite the first face. The first face of each flap is formed from a first yarn type comprising one or more filaments, each filament comprising a filament composition, the filament composition comprising a first polymer and a second polymer different from the first polymer. The second face is formed from a second yarn type different from the first yarn type. Each of the integrally formed flaps in the plurality of integrally formed flaps are in a closed configuration in a first state of the first yarn type, and are in an open configuration in a second state of the first yarn type. The garment additionally comprises a second panel formed from a third yarn type.

Aspects herein are additionally directed to a garment comprising first material and second material, the second material comprising a plurality of integrally formed flaps, wherein the plurality of integrally formed flaps are in a closed configuration in a first state of the second material, and wherein the plurality of integrally formed flaps are in an open configuration in a second state of the second material. When the first material and the second material are in the first state, the first material comprises a first air permeability and the second material comprises a second air permeability, and when the first material and the second material are in the second state, the first material comprises a third air permeability and the second material comprises a fourth air permeability, wherein a percentage of change from the second air permeability to the fourth air permeability is greater than a percentage of change from the first air permeability to the third air permeability.

Positional terms as used herein to describe a garment such as "anterior," "posterior," "front," "back," "upper," "lower," "inner-facing surface," "outer-facing surface," "interior cavity," "inner surface," "outer surface," and the like are with respect to the garment being worn as shown and described herein by a wearer standing in an upright position. The term "adaptive ventilation" in accordance with aspects herein is meant to encompass articles that have the ability to reversibly vary an amount of airflow in and out of an interior cavity of the article(s), in response to an external stimulus. The term "flap" as used herein refers to a structure having a free distal edge and an opposite attachment edge that integrally extends from a textile layer (e.g., a backing layer) where the flap automatically opens and closes in response to the presence or absence of an external stimulus thus, providing the adaptive ventilation characteristics to the article(s) in accordance with aspects herein. For example, the flap may comprise a first face facing the backing layer and a second face opposite to the first face. In a "closed" state of the flap, the flap may be in a substantially co-planar relationship with the backing layer, while in an "open" state, the flap may be in a substantially non-planar relationship with the backing layer. To describe this in a different way, when the flap is in a closed state that flap may have a first angle of deflection formed between the backing layer and the first face that is less than the deflection angle when the flap is in an open state.

As well, the term "integral" as used herein means a textile having at least one textile element (e.g., yarn, filament, and the like) that extends between different areas of a textile. For instance, with respect to the flap described herein, the term "integrally extends" may mean that the attachment edge of the flap is not sewn or otherwise adhered to the backing layer but rather, the yarns forming the flap are interlaced or interlooped with the yarns forming the backing layer at the attachment edge of the flap. The words "integrally formed opening," as used herein are meant to describe that the openings in the backing layer are formed during the knitting or weaving process used for forming the backing layer. The word "engineered opening," as used herein is meant to describe that the openings are formed after the knitting or weaving process used for forming the backing layer by, for example, laser cutting, die cutting, and the like.

Continuing, the term "terephthalate polymer" when describing, for example, a yarn, means a yarn having filaments or fibers formed from terephthalate polymers and includes, for example, polyethylene terephthalate (PET), poly 1,4 cyclohexylene-dimethylene terephthalate (PCDT), polybutylene terephthalate (PCT), and polytrimethylene terephthalate (PTT), and the like. The terephthalate polymer in accordance with aspects herein may be comprised of a cationic dyeable polyethylene terephthalate. A common trade name for PET is polyester. The term "polyamide polymer" when describing yarns, means a yarn having filaments formed from any long-chain synthetic polyamide. The polyamide polymer in accordance with aspects herein may include, for example, a polycaprolactam polymer. The common term for yarns comprising a polycaprolactam polymer is nylon 6.

The term "bi-component" as used herein means a filament or fiber having a polymeric composition comprised of two different types of polymers. A "yarn" as used herein comprises an assemblage of one or more fibers or filaments (multifilament yarns and/or monofilament yarns) where the fibers or filaments may comprise natural or synthetic fibers or filaments. The term "multifilament yarn" as used herein means a yarn having two or more filaments within a single yarn strand while the term "monofilament" as used herein means a yarn formed from a single filament. As used herein, the term "about" means within ±10% of a given value.

Turning now to FIG. 1A, a perspective view of a textile 100 with adaptive ventilation properties is shown. When the textile 100 is incorporated into a garment, the textile 100 may be known as an adaptive ventilation garment portion. The textile 100 comprises a plurality of flaps shown in a closed state, for example, flaps 110, 120, 130, and 140. Each of the flaps 110, 120, 130, and 140 has an attachment edge 112, 122, 132, and 142, respectively, and a distal edge 114, 124, 134, and 144, respectively. Each attachment edge 112, 122, 132, and 142 integrally extends from a backing layer 150, which may be generally concealed by the flaps when the flaps are in their closed state, or it may be partially visible, as shown in FIG. 1A. Further, as shown in FIG. 1A, because the flaps are in the closed state, only a second face 148 of each flap, for example, flaps 110, 120, 130, and 140, is visible.

The attachment edges 112, 122, 132, and 142 of flaps 110, 120, 130 and 140, for example, are in a generally parallel alignment, and the distal edges 114, 124, 134, and 144 of the flaps 110, 120, 130 and 140 are also in a generally parallel alignment so that the textile 100 presents as a series of linearly extending rectangular flaps. Other shape configurations for the textile are contemplated herein. For example, FIG. 1D shows an example textile 104 having the plurality of flaps configured to form a general diamond shape pattern 154, and FIG. 1E shows an example textile 106 having the plurality of flaps configured to form a general zig-zag or sinusoidal shape pattern 156.

With continued respect to FIG. 1A, the attachment edge 142 of flap 140 is adjacent to the distal edge 134 of flap 130, the attachment edge 132 of flap 130 is adjacent to the distal edge 124 of flap 120, and the attachment edge 122 of flap 120 is adjacent to the distal edge 114 of flap 110, thereby generally concealing the backing layer 150 when the flaps are in their closed state. Adjacent in accordance with aspects herein may mean "next to" even though there might be a small gap between a respective attachment edge and an adjacent distal edge, through which a small portion of the backing layer 150 may be visible even if the flaps are in their closed state (as shown in FIG. 1A). Adjacent may also mean "next to" without any gaps present between a respective attachment edge and an adjacent distal edge (not shown). Or adjacent may also mean "next to" when the attachment edge of a first flap is overlapped by the distal edge of second flap, thereby concealing the attachment edge of the first flap. For example, the distal edges 114, 124, 134, and 144, may partially extend over the attachment edges 122, 132, and 142 to give, for example, a window blind effect (not shown). Any and all adjacent configurations for the one or more flaps are possible without departing from aspects in accordance herein. As described above, the flaps generally remain in a closed state until they become exposed to an external stimulus (e.g., moisture, heat, wind, and the like).

Figure 1B:
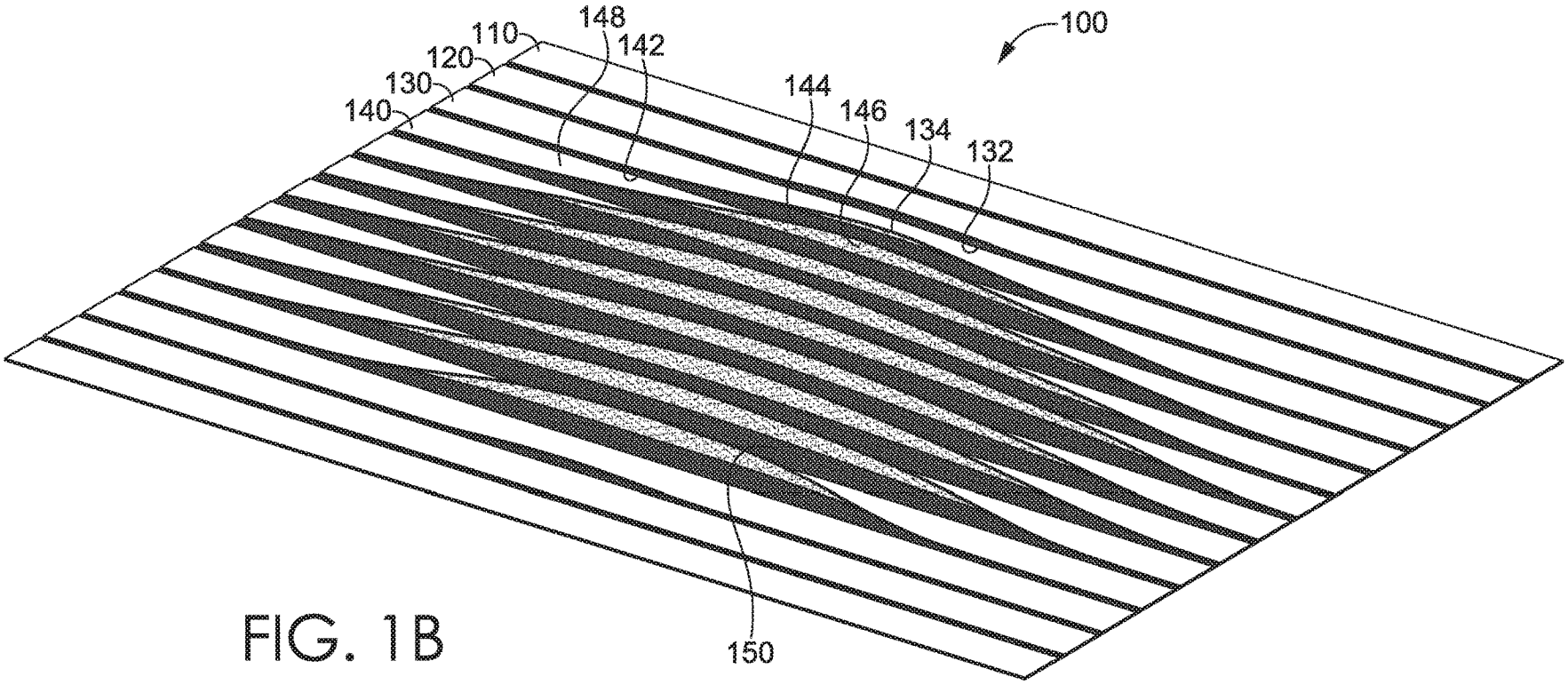
FIG. 1B illustrates the textile of FIG. 1A where the textile is in a second state, exposing portions of the backing layer, in accordance with aspects herein.
Figure 1C:
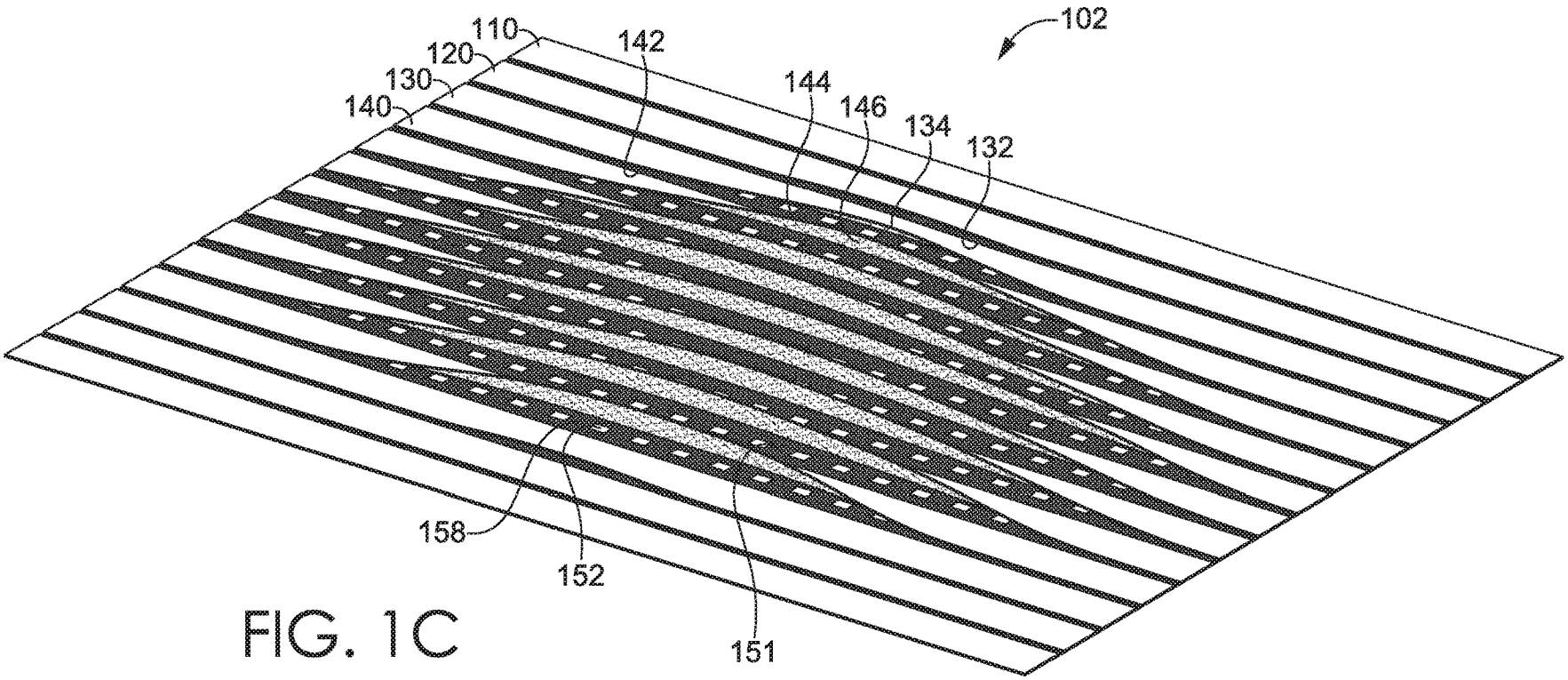
FIG. 1C illustrates an alternative configuration for an adaptive ventilation textile where the textile is in a second state, exposing a a plurality of holes or openings in the backing layer, in accordance with aspects herein.
Figure 1D:
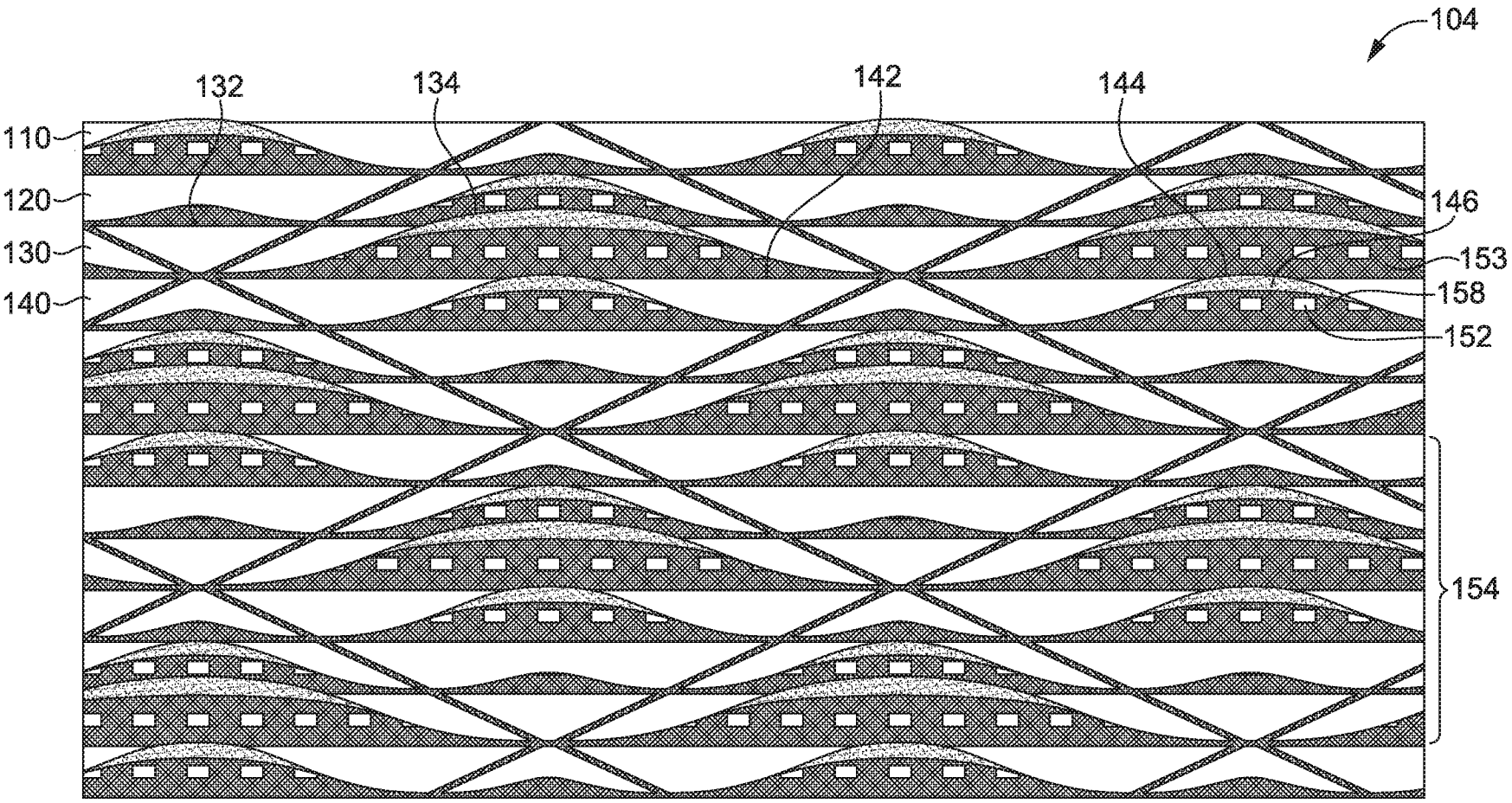
FIG. 1D illustrates another alternative configuration for an adaptive ventilation textile, where the textile is in a second state, in accordance with aspects herein.
Figure 1E:
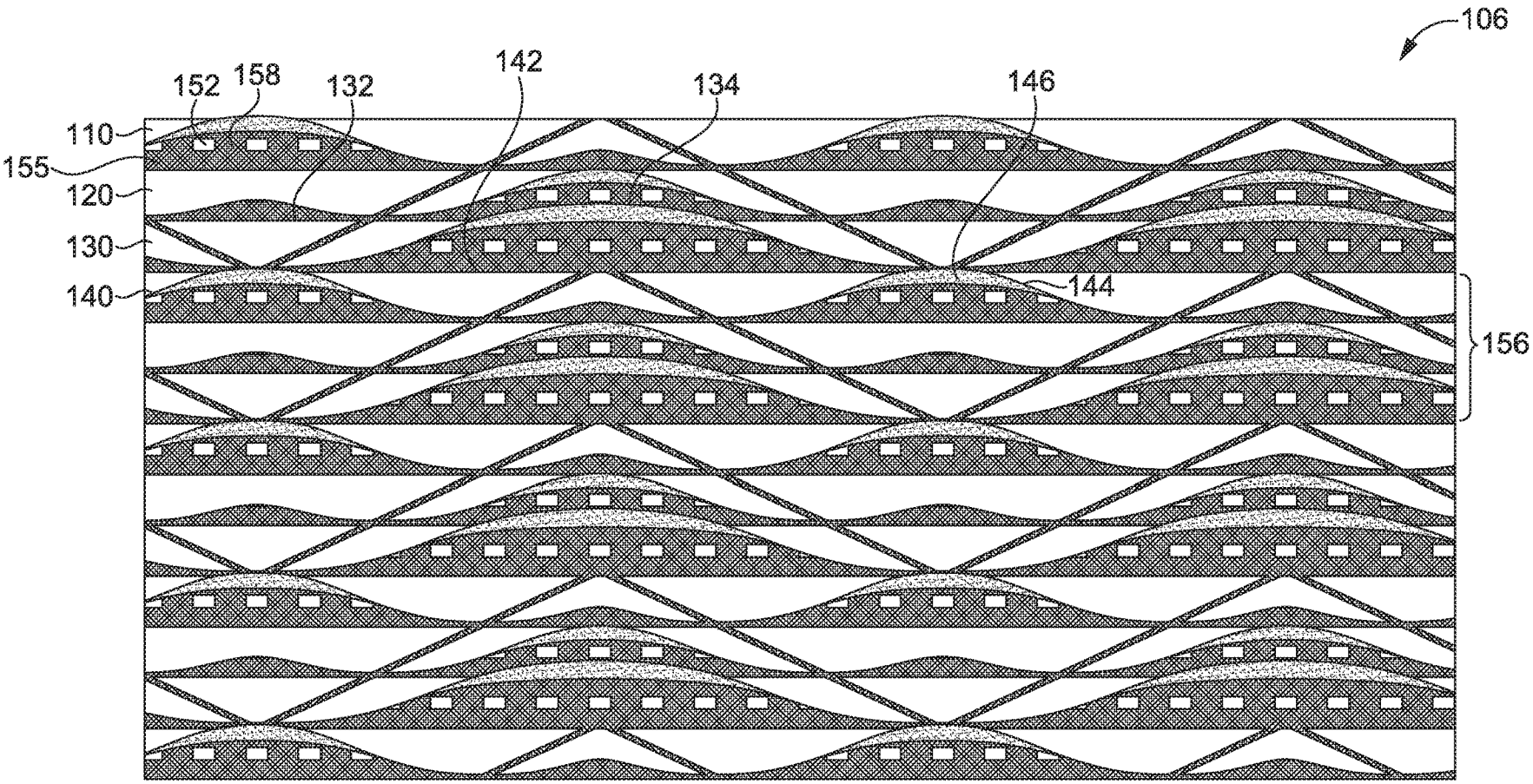
FIG. 1E illustrates yet another alternative configuration for an adaptive ventilation textile, where the textile is in a second state, in accordance with aspects herein.

As shown in FIG. 1B, at least a portion of the flaps 110, 120, 130, and 140 may transition into an open or partially open state when exposed to the external stimulus. As shown, when the flaps 110, 120, 130, and 140 are open, the backing layer 150 (shown with cross-hatching) is exposed and thereby, increased air circulation occurs through the exposed portion of the backing layer 150. As shown by backing layer 151 in textile 102 in FIG. 1C, backing layer 153 in the textile 104 in FIG. 1D, and backing layer 155 in the textile 106 in FIG. 1E, the backing layers 151, 153, and 155 may also comprise a plurality of openings 152. In some aspects, the openings 152 may be integrally formed "through" openings, where "through" openings in accordance with aspects herein are openings that have no obstructions or no yarns filling the opening (for example, opening 213 shown in FIGS. 2A-2C).

In other aspects, the backing layers 151, 153, and 155 may be formed from a combination of stimulus sensitive yarns and non-stimulus sensitive yarns, where the portions of the backing layers 151, 153, and 155 corresponding to the openings 152 may be integrally formed with stimulus sensitive yarns, while the non-opening portions 158 of the backing layer 150 may be integrally formed with non-stimulus sensitive yarns. As such, when one of the example textiles 102, 104, or 106, for example, is exposed to the external stimulus, the stimulus sensitive yarns that form the openings 152 will elongate, as will become more apparent with respect to FIGS. 4D-4G, thereby widening the gaps present between yarns in the backing layers 151, 153, and 155 at the portions of the backing layers 151, 153, and 155 that form the openings 152, which in this case are not "through" openings but rather, the openings 152 may be more like screened windows with yarns present in the openings 152.

Turning back to FIG. 1B, when in the open state, portions of the first face 146 of each flap (shown with stippling), for example, flaps 130 and 140, may be made visible. This is because in the portions of the flaps that are exposed to the external stimulus, the distal edges 134 and 144, of, for example, flaps 130 and 140, transition from a planar state (i.e., distal edges 134 and 144 are substantially in the same plane as their respective attachment edges 132 and 142) to a non-planar state. To describe this differently, the distal edges 134 and 144 curl upward and away from the plane of the backing layer 150, creating for example, a three-dimensional (3-D) effect, making portions of the first face 146 at least partially visible. In other words, an angle of deflection formed between the backing layer 150 and the first face 146 is increased in the portions of each flap that transition from a closed state to an open state, as will become more clear with reference to FIGS. 2A to 2C.

In one example aspect, the first face 146 of one or more flaps may be a different color than the second face 148 of the one or more flaps to create a visual change. The visual change in this instance may serve as a visual indicator of the presence of the external stimulus due to, for example, environmental condition changes or due to changes in the state of a wearer's body, such as when going from a rest state to a warm-up state to a high energy state, for example, during exercise. Moreover, the visual change may also act to distract competitors during, for instance, athletic competitions.

Figure 2C:
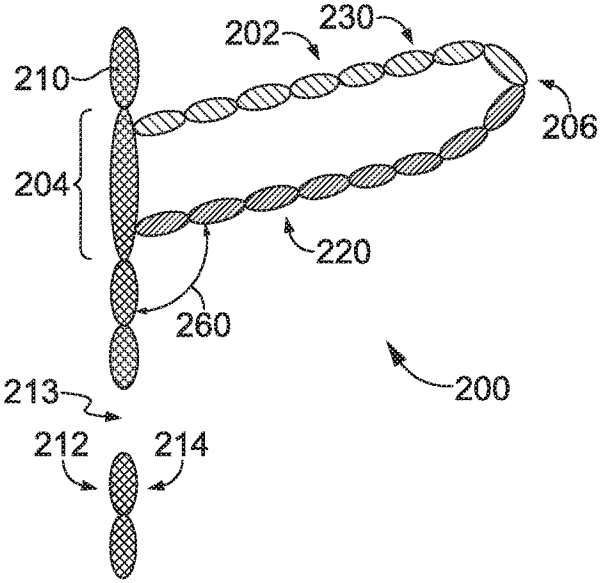
FIGS. 2A to 2C illustrate a transition from the first state to the second state of the textile of FIG. 1A in accordance with aspects herein.
Figure 2B:
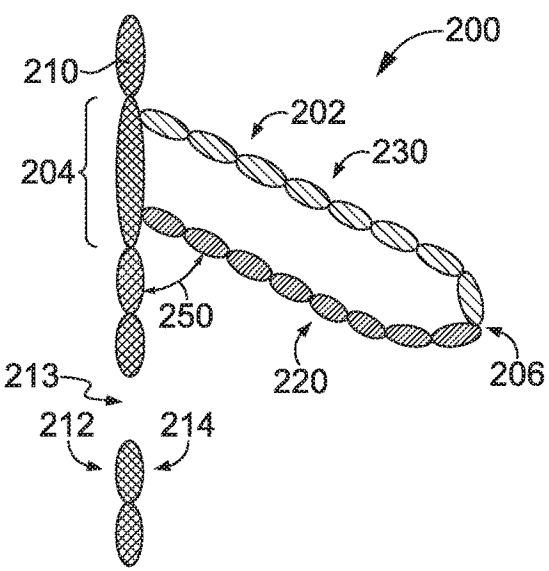
Figure 2A:
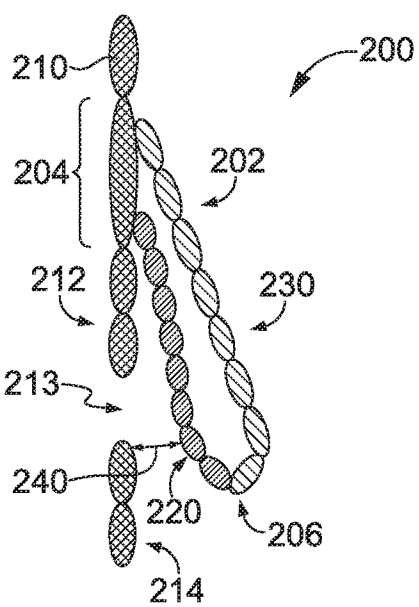

Moving on to FIG. 2A, a schematic view of a cross-section of a flap construction 200 in a closed state is shown, in accordance with aspects herein. The flap construction 200 comprises a backing layer 210 and a flap 202. The flap 202 comprises an attachment edge 204 integrally extending from the backing layer 210, and a free distal edge 206 unaffixed from the backing layer 210. The backing layer 210 comprises a first face 212 configured to face, in one aspect, an inner cavity of a garment (or alternatively, an environment external to the garment when the flaps are provided on an inner surface of the garment, as will be more clear with respect to FIGS. 7A and 7B). The backing layer 210 further comprises a second face 214 configured to face the flap 202, at least in the closed state of the flap 202. Additionally, the backing layer 210 may be a uniform mesh type material (or as described above with respect to FIGS. 1C-1E, may comprise a plurality of openings 152) through which air may flow in and out of a garment when the flap 202 is open and the opening 213 is exposed. The openings 213 may be integrally formed during the formation of the fabric or textile, such as by knitting, weaving, and the like or they may comprise engineered openings.

The flap 202 in turn comprises a first face 220 (inner face) configured to face the backing layer 210, at least in the closed state of the flap 202, and a second face 230 (outer face) configured to face away from the backing layer 210, at least in the closed state of the flap 202. In one aspect, and as shown in FIG. 2A, the flap 202 is shown as having a double-layered construction, however, it is also contemplated herein that the flap 202 may be formed as a generally single layer by providing one or more tie yarns to connect the first face 220 to the second face 230 (not shown).

Figure 3:
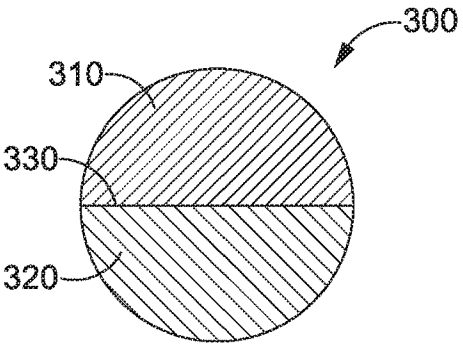
FIG. 3 illustrates a cross sectional view of an adaptive fiber or filament in the textile of FIG. 1A in accordance with aspects herein.

As described above, the first face 220 of the flap 202 may be comprised of a stimulus sensitive yarn type formed from one or more bi-component filaments. Each of the bi-component filaments, as shown in the cross-sectional view 300 in FIG. 3, may be comprised of a stimulus sensitive component 320 and a non-stimulus sensitive component 310 in a side-by-side configuration abutting each other generally at a borderline 330. The borderline 330 may have any suitable shape such as, for example, linear (as shown), curvilinear, wavy, organic, zig-zag, and the like. Although shown generally as linear in FIG. 3, it is contemplated herein that the demarcation between the stimulus sensitive component 320 and the non-stimulus sensitive component 310 may not be as distinct as shown in FIG. 3. For instance, the non-stimulus sensitive and the stimulus sensitive components 310 and 320 may be intermingled slightly at the borderline 330.

Continuing, the stimulus sensitive component 320 may be comprised of a polyamide polymer such as polycaprolactam commonly known as Nylon 6, which may be configured to undergo a physical change from a crimped state to an uncrimped state in response to a change inducing stimulus such as moisture. The non-stimulus sensitive component 310 may be comprised of a terephthalate polymer such as polyethylene terephthalate (PET). In aspects, the PET may comprise a cationic-dyeable PET (CD PET). Further, the CD PET may be modified in order to promote adhesion between the polyamide polymer and the modified CD PET polymer.

Figure 4A:
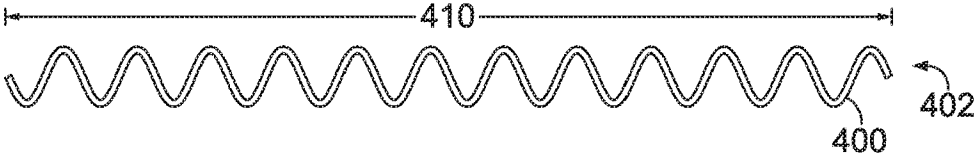
FIGS. 4A to 4C illustrate a transition from a first state to a second state of a yarn incorporating the adaptive fiber or filament of FIG. 3 in accordance with aspects herein.
Figure 4B:
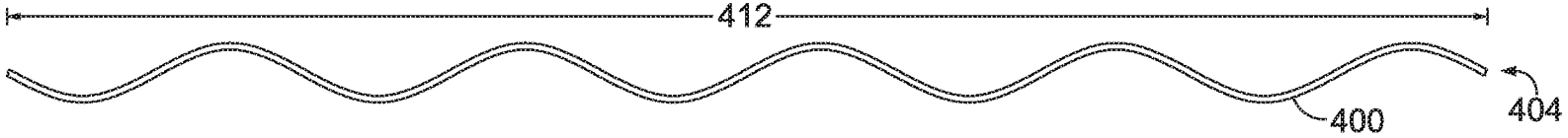
Figure 4C:
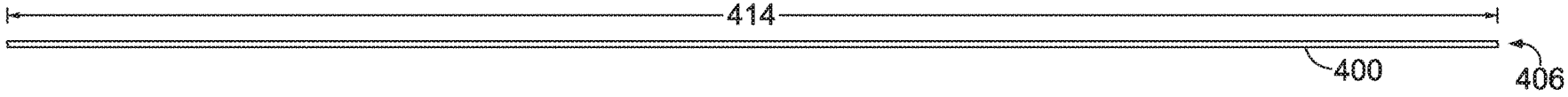
Figure 4D:
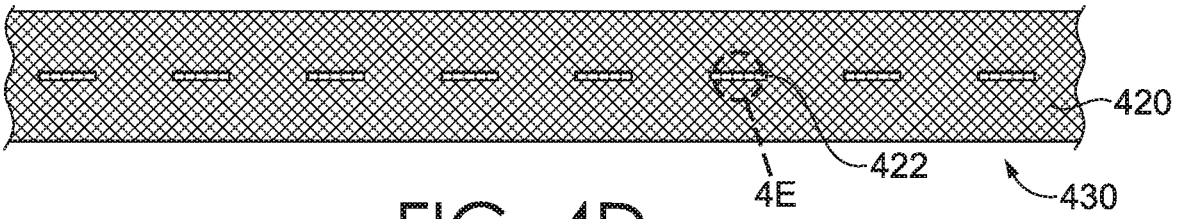
FIGS. 4D-4G illustrate an example configuration of the backing layer comprising portions formed of a yarn incorporating the adaptive fiber where the portions provide increased air permeability, in accordance with aspects herein.
Figure 4E:
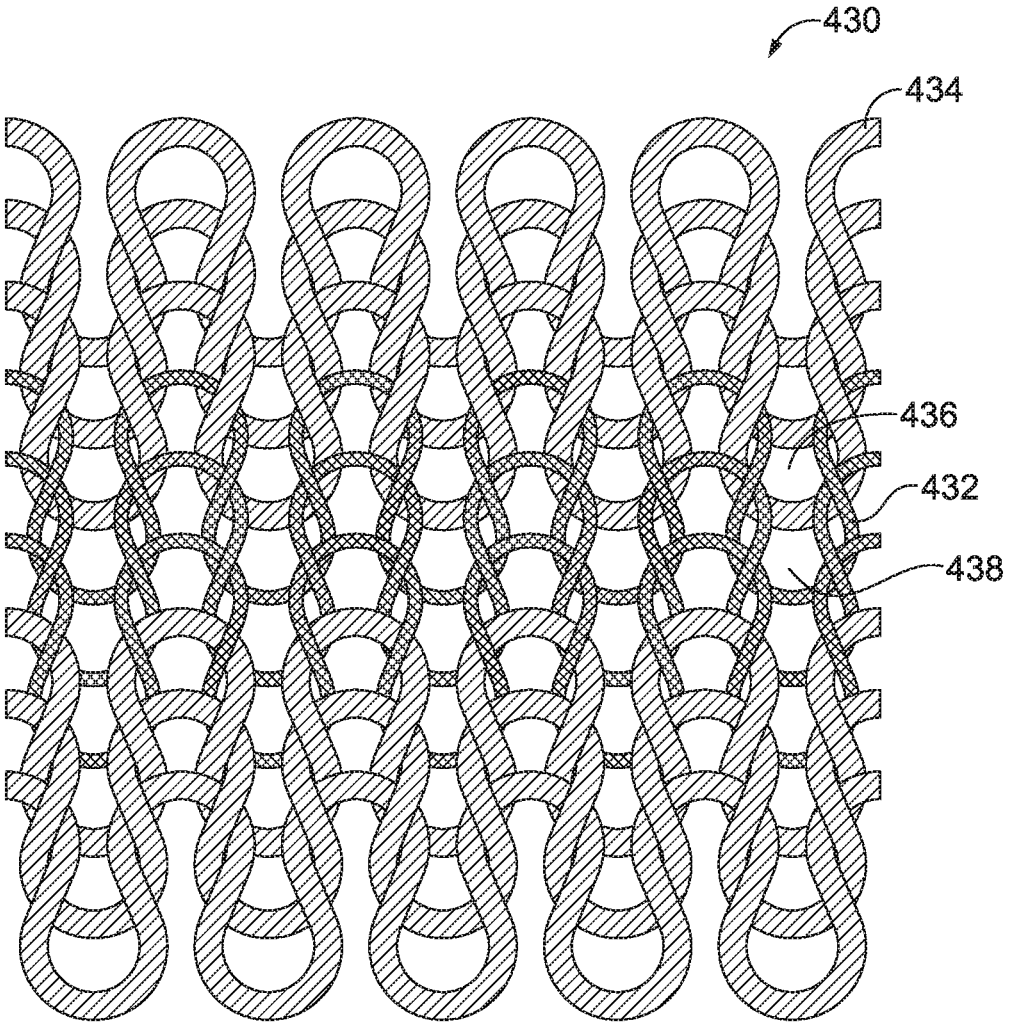

Continuing still, the bi-component filaments due to their polymeric composition and their structural composition, may have an underlying crimping property and thus, in the absence of moisture, exhibit crimping, which effectively shortens the length of the filament. When crimped, the stimulus sensitive component 320 may generally be on inner portions of the crimps, while the non-stimulus sensitive component 310 may generally be on outer portions of the crimps. When exposed to moisture, the moisture is absorbed by the stimulus sensitive component 320, causing the stimulus sensitive component 320 to temporarily "swell" or expand, while the non-stimulus sensitive component 310 will generally not undergo any physical change. Thus, the overall result from moisture absorption is the temporary and reversible lengthening of the bi-component filaments. Because the bi-component filaments generally extend the length of the yarn, the uncrimping and lengthening of the bi-component filaments translates to an uncrimping and lengthening of the yarn that incorporates the filaments. The bi-component filaments will return to their crimped state once moisture has evaporated or has been removed. The crimped state of the bi-component filament may be visualized as shown in FIG. 4A where the length 410 of a bi-component filament 400 is shortened in its crimped state 402. The partial crimped state of the bi-component filament 400 may be visualized as shown in FIG. 4B where the length 412 of the bi-component filament 400 is lengthened in the partial crimped state 404 when compared to the crimped state 402. Finally, the uncrimped state of the bi-component filament 400 may be visualized as shown in FIG. 4C where the length 414 of the bi-component filament 400 is generally completely straightened in its uncrimped state 406.

Figure 4F:
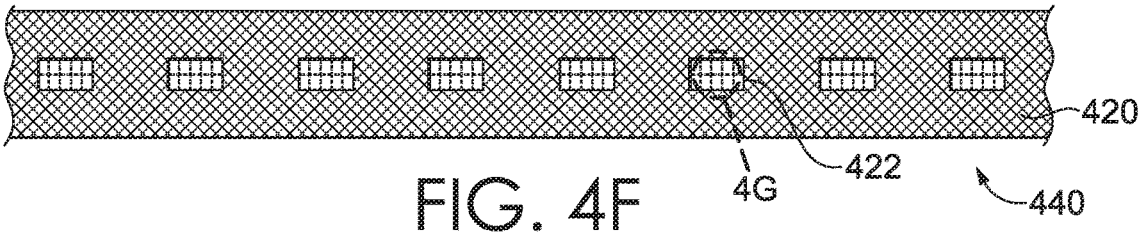
Figure 4G:
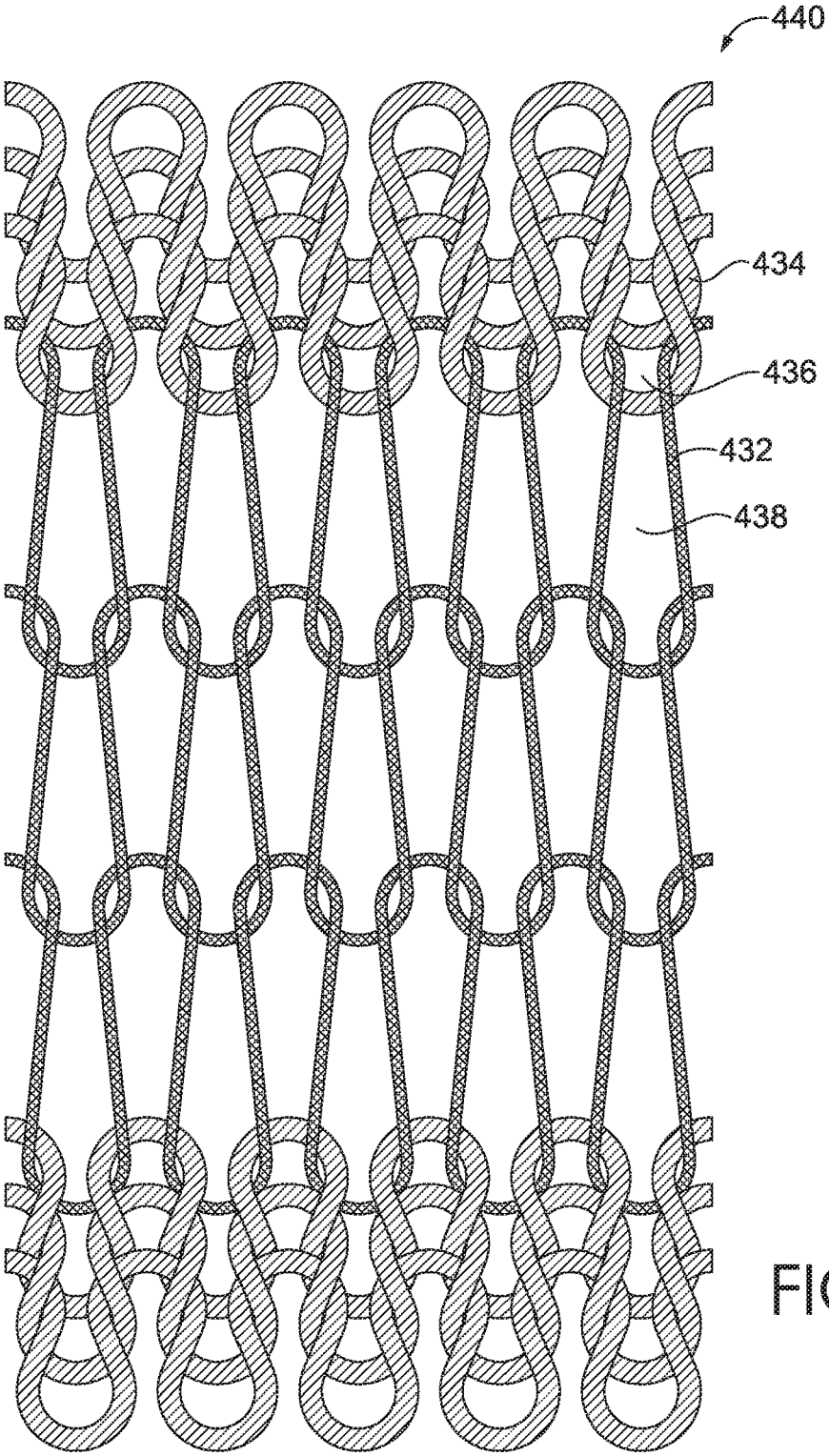

As briefly described above and as shown in FIG. 4D, the bi-component filament 400, or a yarn comprising the bi-component filament 400 may also be incorporated in a backing layer 420 at discrete portions, during the fabric or textile forming process, to form openings 422 having yarn loops or portions of yarn loops present. As shown in the close-up view in FIG. 4E, in a first state 430, where there is no exposure to the external stimulus, the bi-component filament 432, or yarn comprising the bi-component filament 432, may be incorporated during the formation process of the textile or fabric, such as, for example, by integrally knitting the bi-component filament 432, or yarn comprising the bi-component filament 432 with a non-stimulus sensitive filament or yarn 434. Then, as shown in FIG. 4F and in the close-up view in FIG. 4G, in a second state 440, where the fabric or textile is exposed to the external stimulus, the bi-component filament 432, or yarn comprising the bi-component filament 432 elongates, thereby causing the gaps between knit yarns to increase. For example, gap 438 in the second state 440 shown in FIG. 4G in the presence of the external stimulus, is larger that gap 438 in the first state 430 shown in FIG. 4E. However, the gap 436 formed between the non-stimulus sensitive knit fibers or yarns 434 in the backing layer 420, may remain unchanged between the first state 430 and the second state 440. It is also contemplated herein, that the bi-component filament 432, or yarn comprising the bi-component filament 432 may comprise a smaller denier and/or be less textured than the yarn 434.

The increase in the size of the gaps in the openings 422 in the second state 440 may contribute to an increase in air permeability of the backing layer 420 when the backing layer 420 is exposed to an external stimulus such as moisture. Moreover, this feature works in concert with the transition of the flaps from a closed state to an open state in the presence of the external stimulus potentially leading to an overall increase in air permeability of the textiles described herein in the presence of, for instance, moisture. This, in turn, may promote evaporative cooling of a wearer of the textile which improves wearer comfort. This may also promote the evacuation of moisture vapor produced by the wearer during, for example, exercise, further facilitating wearer comfort.

Returning to FIG. 2A, the first face 220 of the flap 202 may be comprised of yarns formed from the stimulus sensitive bi-component filament described with reference to FIG. 3. The second face 230 of the flap 202, on the other hand, may be comprised of a non-stimulus sensitive yarn comprised of a terephthalate polymer such as PET. As shown in FIG. 2A, when there is no stimulus present, the flap is in its closed state with flap 202 being in a generally co-planar relationship with the backing layer 210 and with the first face 220 being in proximity to the second face 214 of the backing layer 210. A first angle of deflection 240 is formed between the second face 214 of the backing layer 210 and the first face 220 of the flap 202. The first angle of deflection 240 may be, for example from about 0° to about 20°, depending on the inherent bulkiness of the flap 202 itself.

Next, when exposed to a degree of the external stimulus, for example, moisture from perspiration traveling from the wearer's skin through the backing layer 210 and onto the first face 220 of the flap 202, the stimulus sensitive component 320 (as shown in FIG. 3), may absorb the moisture, causing the yarns forming the first face 220 of the flap 202 to gradually transition from their crimped state to at least a partially uncrimped state, thereby creating a longitudinal lengthening effect of the first face 220 of the flap 202 as measured between the attachment edge 204 and the free distal edge 206, while the yarns forming the second face 230 of the flap 202 generally stay the same length causing the second face 230 of the flap 202 to generally maintain the same length as measured between the attachment edge 204 and the free distal edge 206. Because the second face 230 of the flap 202 does not lengthen in the presence of the external stimulus, the longitudinal lengthening of the first face 220 of the flap 202 is constrained by the second face 230 so the first face 220 of the flap 202 begins to curl around the free edge of the flap 202 in the direction of the second face 230 in the presence of the external stimulus causing the flap 202 to open and expose the backing layer 210. Depending on the amount of moisture exposure, the yarns forming the first face 220 may only partially uncrimp, such as shown in FIG. 4B. The result may be that the flap 202 may partially open as shown in FIG. 2B, thereby forming a second angle of deflection 250 between the second face 214 of the backing layer 210 and the first face 220 of the flap 202. The second angle of deflection 250 may be, for example from about 21° to about 80°.

As shown in FIG. 2C, when there is enough moisture exposure to cause saturation of the stimulus sensitive component 320 of the bi-component filament, the yarns forming the first face 220 of the flap 202 may reach their maximum length and, thus, cause the flap 202 to fully open, thereby forming a third angle of deflection 260 between the second face 214 of the backing layer 210 and the first face 220 of the flap 202. The third angle of deflection 260 may be, for example, from about 81° to about 130°. It is contemplated that since not all portions of the flap 202 will be exposed to the same amount of moisture along its length at any given time, different portions of the flap 202 may be in different open states that may cause, for example, a ripple-like visual effect. As described above, opening the flap 202 allows for exposure of the openings 213 present in the backing layer 210 to increase airflow though the backing layer 210. Note that the flap 202 in FIGS. 2A-2C is illustrated as being generally linear in cross-section, but it is contemplated herein, that the cross-section of the flap 202 may assume a more curved shape as the flap 202 opens and the first face 220 curls toward the second face 230.

Figure 2D:
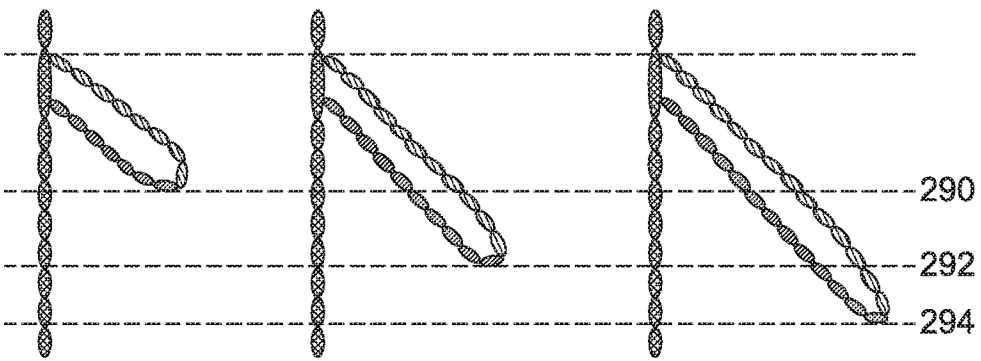
FIG. 2D illustrates how the textile of FIG. 1A can have flaps of differing lengths in accordance with aspects herein.

As briefly described above, adaptive ventilation textile portions in accordance with aspects herein, may comprise "short" flaps, "mid-length" flaps, or "long" flaps. As shown in FIG. 2D, for example, the flap 202 may comprise one of a first intervening length 290, a second intervening length 292, or a third intervening length 294, as measured from its attachment edge 204 to its free distal edge 206. It is contemplated herein that the flap 202 may assume other lengths than those shown in FIG. 2D The application and utility of the adaptive ventilation textile portions comprising the flaps as disclosed in accordance with aspects herein, for articles of manufacture, can be visualized, for example, in garments 500, 600, and 700 shown in FIGS. 5A-7C, where FIGS. 5A, 6A, and 7A/7B show the garments 500, 600, and 700, respectively, in the absence of an external stimulus (e.g., moisture, change in temperature, change in pressure, light, and the like). And FIGS. 5B, 6B, and 7C show the garments 500, 600, and 700, respectively, in the presence of the external stimulus.

Figure 5A:
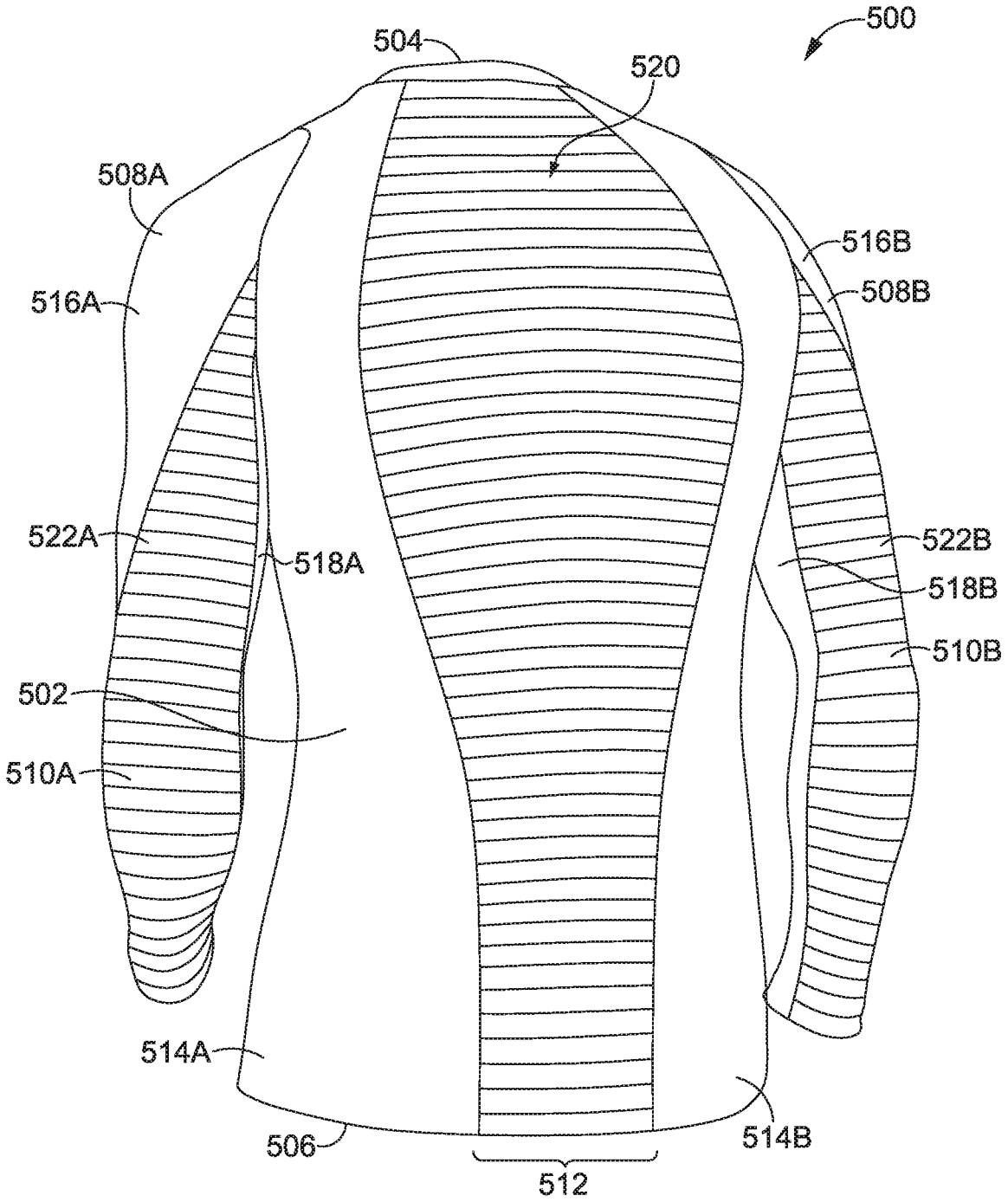
FIG. 5A illustrates an example of a garment incorporating the textile of FIG. 1A, where the textile is in the first state in accordance with aspects herein.
Figure 5B:
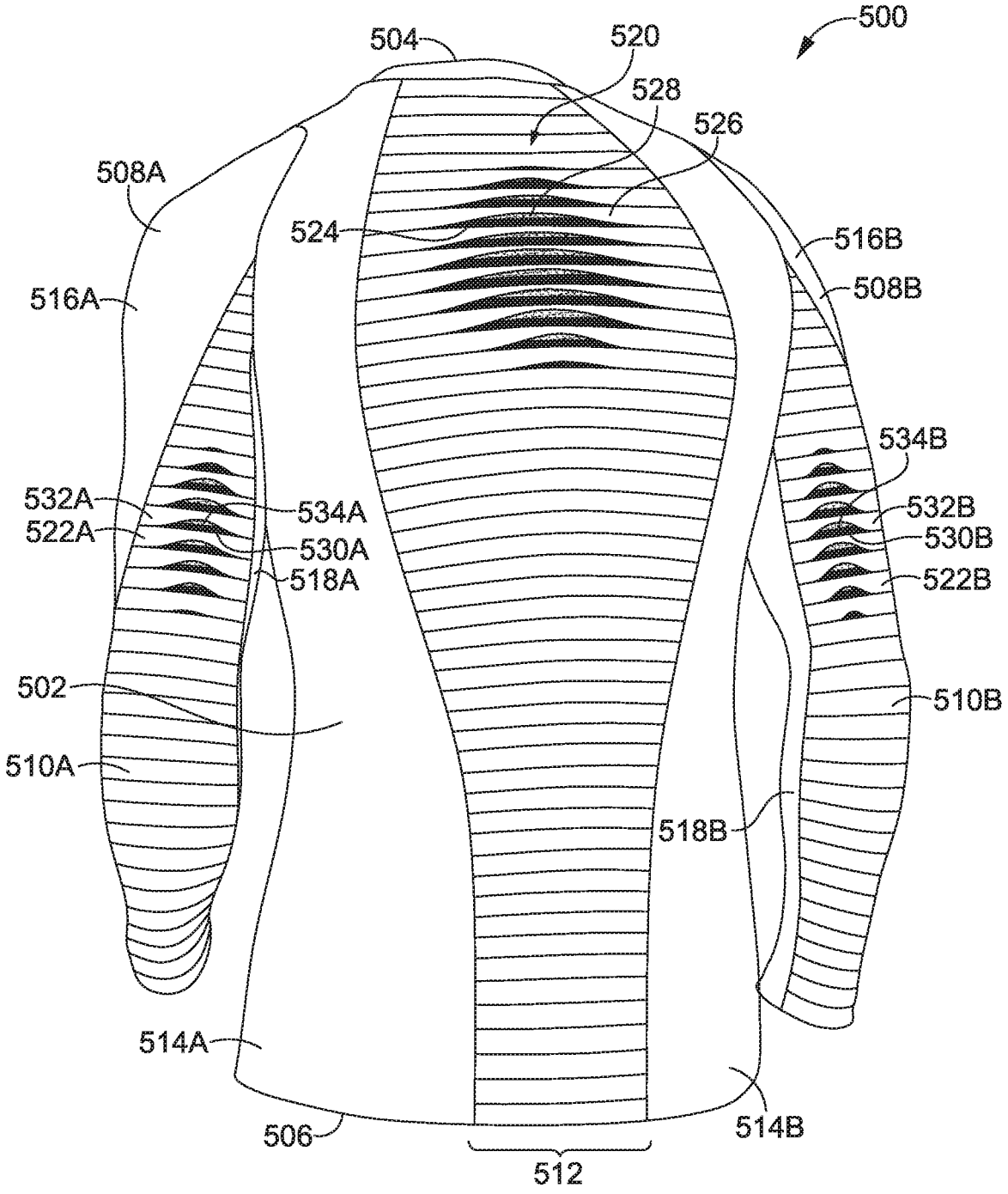
FIG. 5B illustrates the example of a garment shown in FIG. 5A where the textile is in the second state in accordance with aspects herein.

In the example of a garment construction presented in FIG. 5A, the garment 500 is shown as an upper body garment configured to cover an upper body of a wearer when the garment 500 is in an as worn configuration and worn by the wearer as intended. The garment 500, as shown, comprises a torso portion 502 defining a neckline opening 504, a waist opening 506, a first sleeve 508A attached to a first sleeve opening (not shown), and a second sleeve 508B attached to a second sleeve opening (not shown). Although garment 500 is presented as a long sleeved upper body garment, it is contemplated that the garment 500 may comprise any length of sleeve (e.g., three-quarter sleeve, half sleeve, short sleeve, cap sleeve, and the like), alternatively, the upper body garments in accordance with aspects herein, are also envisioned as sleeveless.

Continuing with FIG. 5A, the garments in accordance with aspects herein, such as the garment 500, or the garments 600 and 700, may be comprised of different types of materials by, for example, providing garment forming panels made of different types of fabrics or textiles, where the fabrics or textiles may be comprised of different types of yarns, different types of weave, different types of knit, different types of braid, different types of nonwovens, and the like. As well, the polymeric composition of the different types of yarns, used in the different types of weave, different types of knit, different types of braid, different types of nonwovens and the like, may also differ between the different garment forming panels.

In aspects, the garment 500 may comprise an adaptive ventilation garment forming panel 512 that may be formed from an adaptive ventilation textile, such as the textile 100, having one or more flaps 520 that are capable of opening or closing in response to the external stimulus. The garment 500 may additionally comprise non-adaptive ventilation garment forming panels 514A and 514B that may be formed from a base textile (i.e., a non-adaptive ventilation textile) formed from non-stimulus sensitive yarns, such as, for example, PET yarns. In other words, the non-adaptive ventilation garment forming panels 514A and 514B, may be comprised of woven, knit, or nonwoven fabrics or textiles that generally do not undergo a physical change when exposed to the external stimulus triggering the physical change in the adaptive ventilation garment forming panel 512. Similarly, in the event that the garment 500 comprises sleeves, such as first and second sleeves 508A and 508B, the first and second sleeves 508A and 508B may comprise adaptive ventilation garment forming panels 510A and 510B, having one or more flaps 522A and 522B, respectively, and non-adaptive ventilation garment forming panels 516A, 518A, 516B, and 518B, respectively. It is also contemplated that the first and second sleeves 508A and 508B, may not comprise any adaptive ventilation garment forming panels, or in other words, the sleeves may be formed of only non-adaptive ventilation garment forming panels (not shown). The positioning, configuration, size, and location of the adaptive ventilation garment forming panels and the non-adaptive ventilation garment forming panels illustrated in FIG. 5A are examples only, and it is contemplated that the garment 500 may comprise other configurations in accordance with aspects herein.

Further, in some aspects, the adaptive ventilation garment forming panels (e.g., 512, 510A, 510B) and the non-adaptive ventilation garment forming panels (e.g., 514A, 514B, 516A, 518A, 516B, and 518B) may be joined together by seams formed by stitching, bonding, adhering, or any other suitable method, for constructing the final garment. As well, in other aspects, the adaptive ventilation garment forming panels (e.g., 512, 510A, 510B) and the non-adaptive ventilation forming panels (e.g., 514A, 514B, 516A, 518A, 516B, and 518B) may be integrally formed together by any suitable method such as knitting, weaving, and the like (i.e., no seams needed to join the different panels together).

FIG. 5B depicts the garment 500 in the presence of the external stimulus. For example, the external stimulus may be moisture. The moisture may be generated, for example, from a wearer's body in the form of perspiration, when the wearer is engaged in a physical activity or sport. The moisture absorbed by the adaptive ventilation garment forming panel 512 causes the one or more flaps 520 to open and expose the backing layer 524. As described above, the backing layer 524 may be comprised of a mesh type material, or a material having a plurality of integrally formed openings that may allow more air to flow in an out of an interior cavity of the garment 500 as compared to when the one or more flaps 520 are closed. In accordance with other aspects, as described above with respect to FIGS. 4D-4G, the openings formed on the backing layer 524 may be integrally and uniformly knit, where portions of the backing layer 524 corresponding to the openings may be knit with the stimulus sensitive yarns, while the non-opening portions of the backing layer 524 may be knit with the non-stimulus sensitive yarns. As such, when the adaptive ventilation garment is exposed to moisture, the stimulus sensitive yarns may elongate, loosening the knit in the areas knit with the stimulus sensitive yarns to provide screened window-like openings in the backing layer 524.

In aspects, the percent change in air permeability for the adaptive ventilation garment forming panel 512 when the flaps transition from a closed state to an open state in response to, for example, moisture, may be greater than a percent change in air permeability for the non-adaptive ventilation garment forming panels 514A and 514B, for example, which are formed from a base textile, or in other words, a non-adaptive ventilation textile. For example, when the garment 500 is exposed to an external stimulus, such as, for example, moisture from a wearer's body in the form of perspiration, the adaptive ventilation garment forming panels 512, 510A and 510B of the garment 500 and/or textile portions thereof, may exhibit a positive change in air permeability as measured using, for example, ASTM D737-Standard Test Method for Air Permeability of Textile Fabrics. This testing method is performed on both wet and dry specimens. In other words, the air permeability is measured on both wet and dry specimens. In aspects, the test method may be modified by decreasing the pressure differential to 20 Pa (versus 125 Pa in the ASTM D737 test) to prevent the wet textile from drying out too quickly and to more closely approximate the air flow and/or air pressure experienced by, for instance, a runner while running.

More particularly, when the adaptive ventilation garment forming panels 512, 510A, and 510B or textile portions thereof are exposed to an external stimulus such as water or moisture from perspiration, the adaptive ventilation garment forming panels 512, 510A, and 510B may have from about 20.0 to about 75.0%, from about 25.0 to about 73.0%, or from about 27.4 to about 70.2% positive change in air permeability when going from a dry state to a wet state, with the percent change being higher with a longer intervening length for the flaps 520. For example, the adaptive ventilation garment forming panels 512, 510A, and 510B or textile portions thereof, may exhibit an air permeability of from about 50 $ft^3$/min to about 105 $ft^3$/min when dry and an air permeability from about 80 $ft^3/min^2$ to about 130 $ft^3$/min when wet, or from about 52 $ft^3$/min to about 99 $ft^3$/min when dry and an air permeability from about 85 $ft^3$/min to about 127 $ft^3$/min when wet, or from about 54 $ft^3$/min to about 99 $ft^3$/min when dry and an air permeability from about 87 $ft^3$/min to about 126 $ft^3$/min when wet.

When the non-adaptive ventilation garment forming panels 514A, 514B, 516A, 518A, 516B, and 518B or textile portions thereof are exposed to the external stimulus such as water or moisture from perspiration, the textiles may have from about −7.0% to about +10%, from about −5.0 to about +9.0%, or from about −4.0 to about +8.4% change in air permeability when going from a dry state to a wet state. In this instance, the non-adaptive ventilation garment forming panels 514A, 514B, 516A, 518A, 516B, and 518B or textile portions thereof may exhibit an air permeability from about 5 $ft^3$/min to about 32 $ft^3$/min when dry and an air permeability from about 5 $ft^3$/min to about 34 $ft^3$/min when wet, or from about 6 $ft^3$/min to about 30 $ft^3$/min when dry and an air permeability from about 6 $ft^3$/min to about 33 $ft^3$/min when wet, or from about 7 $ft^3$/min to about 29.8 $ft^3$/min when dry and an air permeability from about 7 $ft^3$/min to about 32.3 $ft^3$/min when wet.

Accordingly, garments such as garment 500, or garments 600 and 700 in accordance with aspects herein, are comprised of adaptive ventilation garment portions (e.g., the adaptive ventilation garment forming panels 512, 510A, and 510B) having a first air permeability under dry conditions and a second air permeability under wet conditions, and non-adaptive ventilation garment portions (e.g., the non-adaptive ventilation garment forming panels 514A, 514B, 516A, 518A, 516B, and 518B) having a third air permeability under dry conditions and a fourth air permeability under wet conditions, where a first percent change in air permeability from dry to wet conditions in the adaptive ventilation garment portions is greater than a second percent change in air permeability from dry to wet conditions in the non-adapative ventilation garment portions. In other words, the first percent change is greater than the second percent change.

Depending on the degree of moisture present, a first face 528 of the flaps 520 may become visible, while the portions of the flaps 520 that are not exposed to moisture, may visually present a second face 526. This difference may create a wave-like 3-D effect in the adaptive ventilation garment forming panel 512. As such, in order to make a more pronounced visual effect, the first face 528 of the one or more flaps 520, may be comprised of a color that is different than the second face 526 of the one or more flaps 520. Moreover, the backing layer 524 may be the same or a different color than the first face 528 and/or the second face 526, and may also be a different color than the base textile of the non-adaptive ventilation garment forming panels 514A and 514B.

The same may apply to the adaptive ventilation garment forming panels 510A and 510B, where the presence of moisture causes the backing layer 530A and 530B to be exposed. Further, depending on the level of moisture absorbed in certain regions of the garment 500, an inner face 534A and 534B of the one or more flaps 522A and 522B may be exposed, while in other portions of the garment 500, where there is no moisture, the one or more flaps 522A and 522B may remain closed such that only the outer face 532A and 532B of the flaps 522A and 522B remain visible. Since different areas of a wearer's body may perspire to different degrees, it is contemplated that different portions of a single flap 520 may open to different degrees along the length of the flap 520 depending on how much moisture is present. For example, a first portion of a flap 520 may absorb more perspiration from the wearer compared to a second portion of the same flap 520. Thus, the first portion of the flap 520 would open to a greater degree than the second portion of the same flap 520.

Figure 6A:
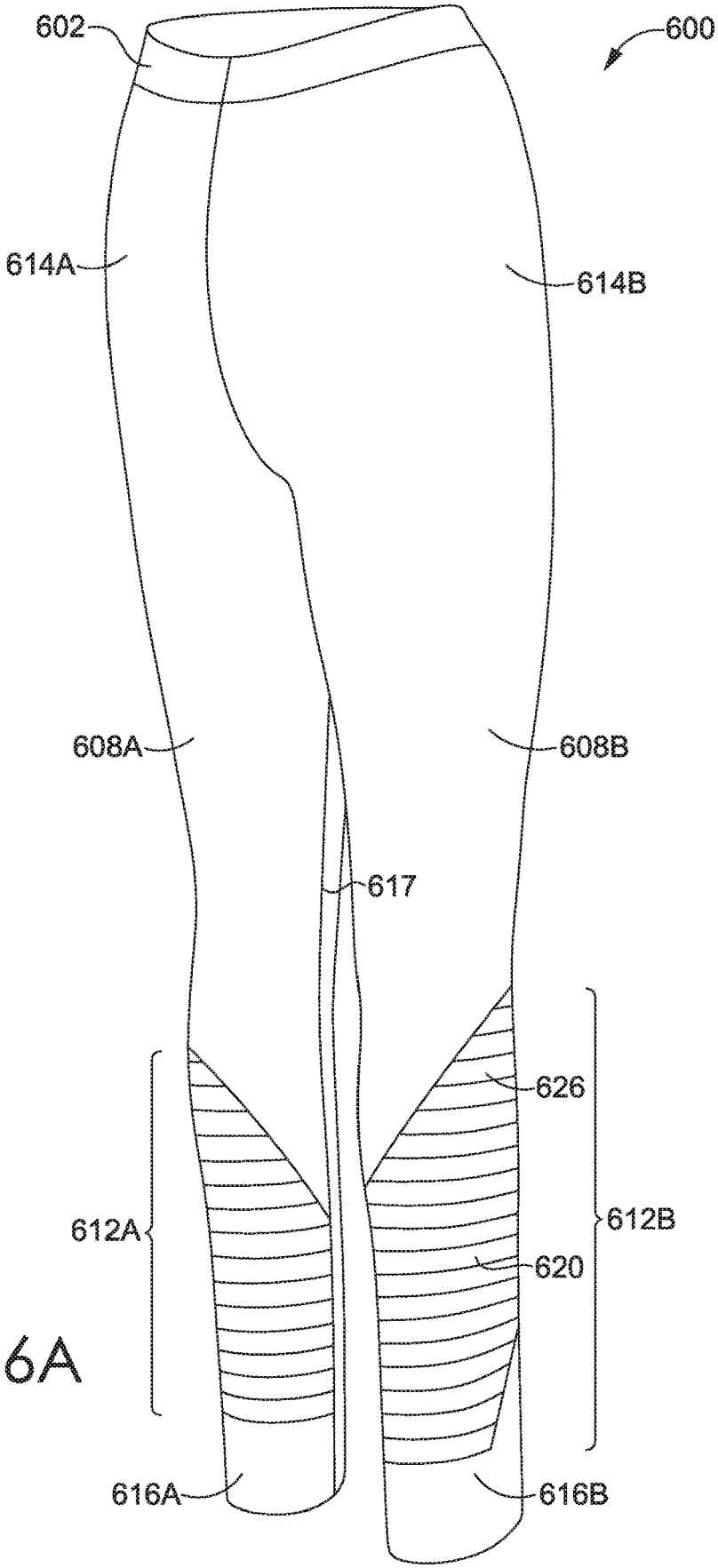
FIG. 6A illustrates another example of a garment incorporating the textile shown of FIG. 1A, where the textile is in the first state in accordance with aspects herein.
Figure 6B:
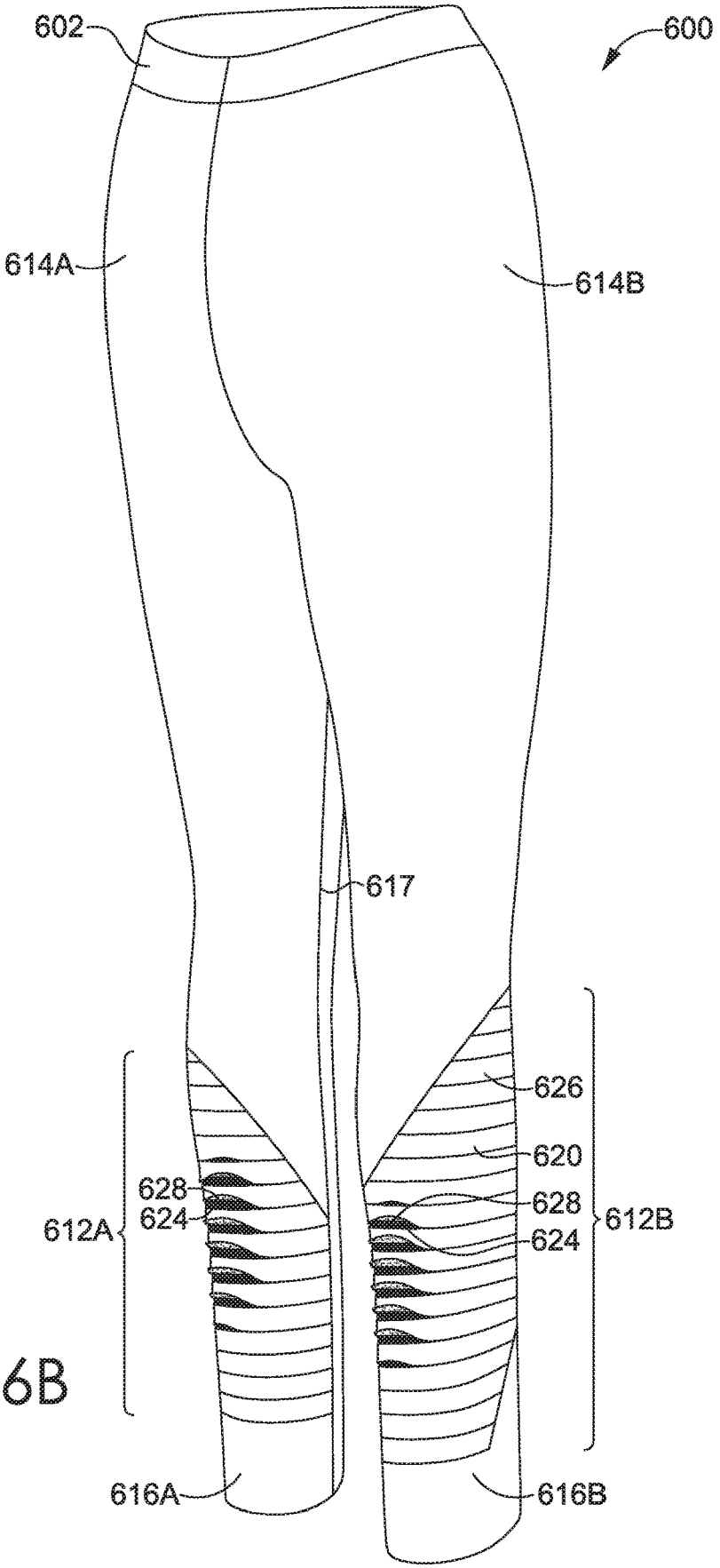
FIG. 6B illustrates the garment of FIG. 6A where the textile is in the second state in accordance with aspects herein.
Figure 7C:
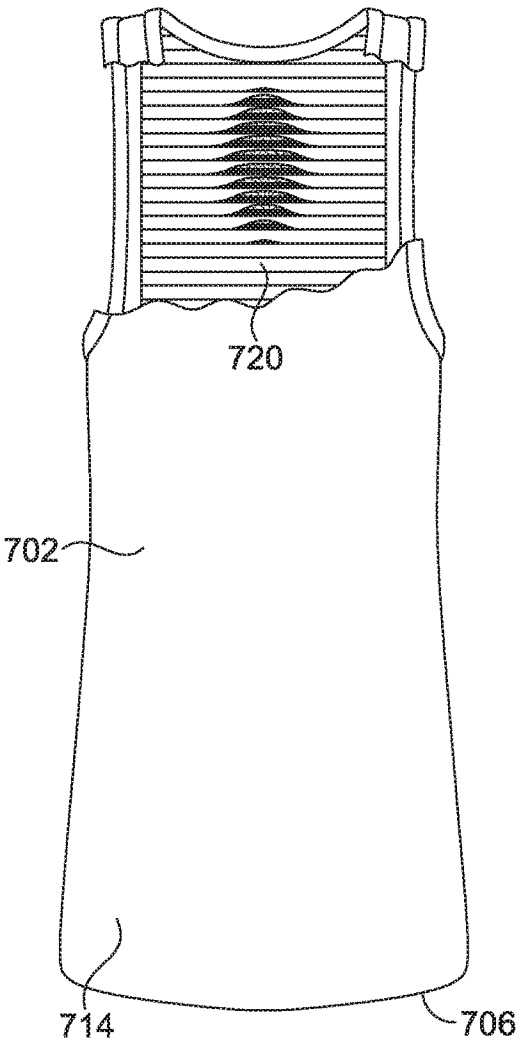
FIG. 7C illustrates a cut-out view of the garment of FIG. 7A where the textile is in the second state in accordance with aspects herein.

In the example of a garment construction presented in FIG. 6A, garment 600 is shown as a lower body garment configured to cover a lower body of a wearer when the garment 600 is in an as-worn configuration and worn by the wearer as intended. The garment 600, as shown, comprises a waist portion 602, a first pant leg 608A and a second pant leg 608B. Although garment 600 is presented as a pair of long pants, it is contemplated that the garment 600 may comprise any length for the pant leg (e.g., short length (slightly below the crotch area), Bermuda length (right above the knee), Capri length (below the knee and above the ankle), and the like).

Continuing with FIG. 6A, garment 600 may comprise adaptive ventilation garment forming panels 612A and 612B having one or more flaps 620 that are capable of opening or closing in response to the external stimulus. Non-adaptive ventilation garment forming panels 614A and 614B, 616A and 616B, and 617, on the other hand, may be formed from a base textile, i.e., non-adaptive ventilation textile formed from non-stimulus sensitive yarns and thus comprise non-adaptive ventilation garment forming panels. It is contemplated that the adaptive ventilation garment forming panels 612A and 612B, although shown as being located at an area of the garment 600 aligning with the calves of a wearer, may be located in other areas as well that may align with areas of higher perspiration.

FIG. 6B depicts the garment 600 in the presence of the external stimulus. For example, as described above, the external stimulus may be moisture. The moisture absorbed by the adaptive ventilation garment forming panels 612A and 612B causes the one or more flaps 620 to open and expose the backing layer 624. The specific characteristics of the adaptive ventilation garment forming panels 612A and 612B and the non-adaptive ventilation garment forming panels 614A and 614B, 616A and 616B, and 617 may have the same or similar characteristics, as described above with respect to garment 500 shown in FIGS. 5A and 5B.

Figure 7B:
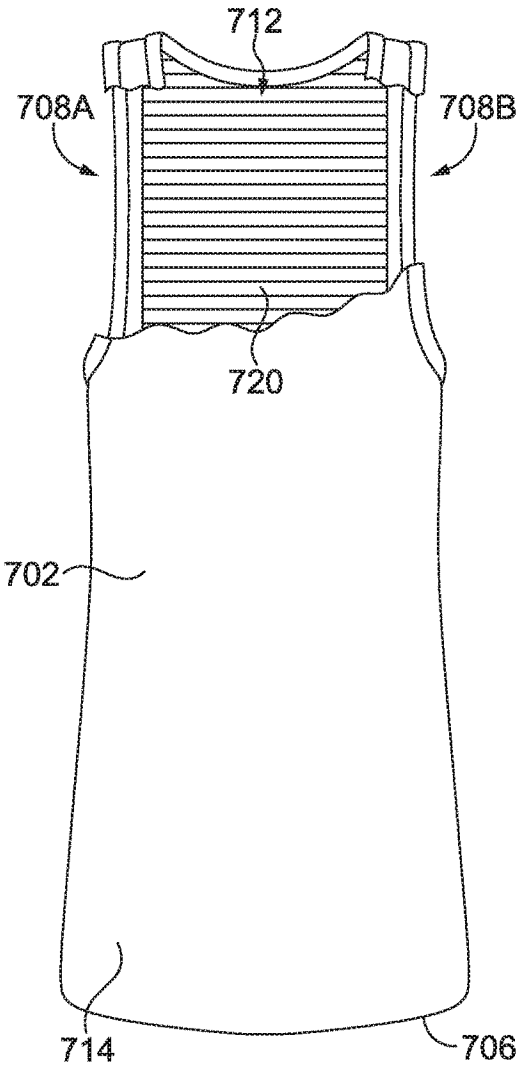
FIG. 7B illustrates a cut-out view of the garment of FIG. 7A, where the textile is in the first state in accordance with aspects herein.
Figure 7A:
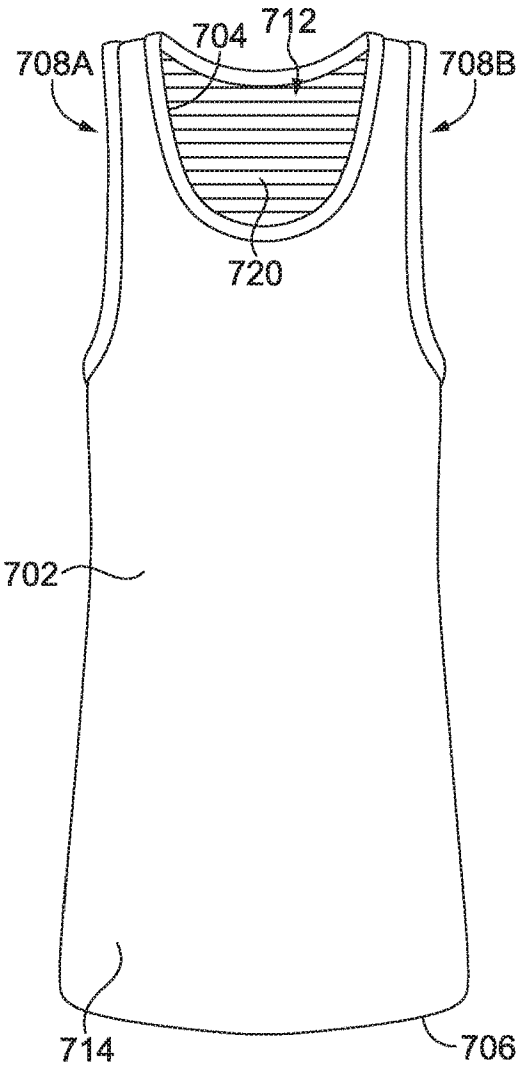
FIG. 7A illustrates a different example of a garment incorporating the textile of FIG. 1A, where the textile is in the first state in accordance with aspects herein.

In the example of a garment construction presented in FIG. 7A, garment 700 is shown as an upper body garment configured to cover an upper body of a wearer when the garment 700 is in an as-worn configuration and worn by the wearer as intended. The garment 700, as shown, comprises a torso portion 702 defining a neckline opening 704, a waist opening 706, a first armhole 708A, and a second armhole 708B. Although garment 700 is presented as a sleeveless upper body garment, it is contemplated that the garment 700 may comprise sleeves of any length of sleeve (e.g., three-quarter sleeve, half sleeve, short sleeve, cap sleeve, long sleeve, and the like.) Alternatively, the garment 700 may also be a lower body garment, such as the one shown in FIGS. 6A and 6B, but with the adaptive configuration of the garment 700, as will be further described below.

Continuing with FIG. 7B, the garment 700 may comprise an adaptive ventilation garment forming panel 712 having one or more flaps 720 that are capable of opening or closing in response to the external stimulus. Non-adaptive ventilation garment forming panel 714, on the other hand, may be formed from a base textile (i.e., a non-adaptive ventilation textile) and thus may comprise a non-adaptive ventilation garment forming panel. Unlike the garments shown in FIGS. 5A-6B, however, the flaps 720 are configured to face the wearer's body surface rather than an external environment. This configuration of the adaptive ventilation garment forming panel 712 may allow for the creation of stand-off or offset from the wearer's body surface, as shown in FIG. 7C, in the presence of, for example, moisture. As the one or more flaps 720 open in response to the moisture from perspiration, a space between the wearer's skin and the garment 700 is created, allowing air to flow inside the garment 700 where otherwise airflow may be more limited due to the garment panels being in direct contact with the wearer's skin. This configuration may be beneficial for garments such as tank tops formed of breathable or highly air permeable materials to provide more air flow through the garment, for example, to enhance comfort, especially when the wearer's perspiration increases with the length and/or the intensity of physical activity. The specific characteristics of the adaptive ventilation garment forming panel 712 and the non-adaptive ventilation garment forming panel 714 may have the same or similar air permeability characteristics as garment 500 described above with respect to FIGS. 5A and 5B.

As described above with reference to FIG. 2D, in accordance with aspects herein, the one or more flaps of the adaptive ventilation textile may be of different sizes or lengths depending upon the intervening length between the attachment edge and the distal edge of a respective flap. In example aspects, the longer a given flap (i.e., the longer the flap's intervening length), the less number of flaps may be needed to cover a given surface area of the backing layer. In other words, the greater length of each flap, the more surface area of the backing layer that it may cover (in its closed state) and the greater the surface area that is exposed when the flap is in an open state in response to an external stimulus. Thus, the amount of ventilation or air movement between an inner cavity of the garment and the outer environment, when at least a portion of the flap is open, may be proportional to the intervening length between the attachment edge and the distal edge of the flap.

As well, the amount of ventilation or air movement between an inner cavity of the garment and the outer environment, when at least a portion of the flap is open, may be proportional to the number of flaps in a given area of the garment. For instance, the more flaps present in the garment within a given area, the more potential for air flow when at least portions of the flaps are in an open state.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A garment comprising:

a torso portion defining a neckline opening, a waist opening, a first arm opening, and a second arm opening; and a flap located on a back aspect of the torso portion a predefined distance superior to the waist opening, the flap having an attachment edge, the flap comprising a first face and a second face opposite the first face, the first face formed from a first yarn type, the first yarn type comprising a plurality of bi-component filaments, each bi-component filament comprising a polyamide polymer and a terephthalate polymer, the second face formed from a second yarn type, the second yarn type comprising a polymeric composition different from the bi-component filament on the first face, wherein the flap further comprises a distal edge and an intervening length between the attachment edge and the distal edge, wherein the attachment edge integrally extends from a backing layer and the distal edge is unaffixed from the backing layer, wherein the first face of the flap faces the backing layer.

2. The garment of claim 1, wherein the flap comprises a first angle of deflection formed between the backing layer and the flap at the attachment edge in an absence of an external stimulus, and wherein the flap comprises a second angle of deflection formed between the backing layer and the flap at the attachment edge in a presence of the external stimulus.

3. The garment of claim 2, wherein the second angle of deflection is greater than the first angle of deflection.

4. The garment of claim 2, wherein the external stimulus is moisture.

5. The garment of claim 1, further comprising a second flap comprising a second attachment edge and a second distal edge with a second intervening length between the second attachment edge and the second distal edge.

6. The garment of claim 5, wherein in a closed configuration, the attachment edge of the flap is concealed by the second distal edge of the second flap.

7. A garment comprising:

a first panel comprising a plurality of integrally formed flaps, each of the plurality of integrally formed flaps having a first face and a second face opposite the first face, wherein:

the first face is formed from a first yarn type comprising one or more filaments, each filament comprising a filament composition, the filament composition comprising a first polymer and a second polymer different from the first polymer, the second face is formed from a second yarn type different from the first yarn type, the plurality of integrally formed flaps are in a closed configuration in a first state of the first yarn type, and the plurality of integrally formed flaps are in an open configuration in a second state of the first yarn type; and a second panel formed from a third yarn type.

8. The garment of claim 7, wherein the first polymer and the second polymer in the first yarn type are in a side-by-side arrangement.

9. The garment of claim 7, wherein the first polymer comprises a polyamide polymer, and wherein the second polymer comprises a terephthalate polymer.

10. The garment of claim 9, wherein the terephthalate polymer is polyethylene terephthalate.

11. The garment of claim 10, wherein the polyethylene terephthalate is a cationic-dyeable polyethylene terephthalate.

12. The garment of claim 9, wherein the polyamide polymer is polycaprolactam.

13. The garment of claim 7, wherein the second yarn type comprises a terephthalate polymer.

14. The garment of claim 7, wherein each of the plurality of integrally formed flaps comprises an attachment edge and a distal edge with an intervening length between the attachment edge and the distal edge, wherein the attachment edge integrally extends from a backing layer and wherein the distal edge is unaffixed from the backing layer.

15. The garment of claim 14, wherein each integrally formed flap of the plurality of integrally formed flaps forms a first angle of deflection between the backing layer and the each integrally formed flap at the attachment edge when the plurality of integrally formed flaps are in the closed configuration, and wherein at least a portion of the each integrally formed flap forms a second angle of deflection between the backing layer and the each integrally formed flap at the attachment edge when the plurality of integrally formed flaps are in the open configuration.

16. The garment of claim 15, wherein the second angle of deflection in the open configuration is greater than the first angle of deflection in the closed configuration.

17. The garment of claim 15, wherein the plurality of integrally formed flaps transition from the closed configuration to the open configuration in a presence of an external stimulus.

18. The garment of claim 17, wherein the external stimulus is one of moisture, wind pressure, temperature, or light.

19. A garment comprising:

a first material; and a second material, the second material comprising a plurality of integrally formed flaps, wherein each integrally formed flap comprises a first face and an opposite second face, wherein the first face is formed from a first yarn type that is sensitive to an external stimulus, and wherein the opposite second face is formed from a second yarn type that is not sensitive to the external stimulus, wherein the plurality of integrally formed flaps are in a closed configuration in a first state of the second material, and wherein the plurality of integrally formed flaps are in an open configuration in a second state of the second material, wherein each flap in the plurality of integrally formed flaps comprises a distal edge and an attachment edge, wherein the attachment edge of a first integrally formed flap in the plurality of integrally formed flaps is concealed by the distal edge of a second integrally formed flap in the plurality of integrally formed flaps in the first state, wherein:

when the second material is in the first state, the second material comprises a first air permeability, and when the second material is in the second state, the second material comprises a second air permeability, wherein the second air permeability is greater than the first air permeability.

20. The garment of claim 19, wherein the first material comprises a third air permeability in the first state and a fourth air permeability in the second state, wherein a first percentage change from the first air permeability to the second air permeability is greater than a second percentage change from the third air permeability to the fourth air permeability.

* * * * *